US010169996B2

(12) United States Patent
Liu

(10) Patent No.: US 10,169,996 B2
(45) Date of Patent: Jan. 1, 2019

(54) METHOD AND APPARATUS FOR ESTIMATION OF WAITING TIME TO PARK

(71) Applicant: HERE GLOBAL B.V., Eindhoven (NL)

(72) Inventor: Xiang Liu, Eindhoven (NL)

(73) Assignee: HERE Global B.V., Eindhoven (NL)

( * ) Notice: Subject to any disclaimer, the term of this patent is extended or adjusted under 35 U.S.C. 154(b) by 0 days.

(21) Appl. No.: 15/598,043

(22) Filed: May 17, 2017

(65) Prior Publication Data

US 2018/0336784 A1 Nov. 22, 2018

(51) Int. Cl.
*G08G 1/14* (2006.01)

(52) U.S. Cl.
CPC ..... *G08G 1/143* (2013.01); *G08G 1/141* (2013.01); *G08G 1/14* (2013.01); *G08G 1/147* (2013.01)

(58) Field of Classification Search
None
See application file for complete search history.

(56) References Cited

U.S. PATENT DOCUMENTS

| | | | | |
|---|---|---|---|---|
| 7,936,284 | B2 | 5/2011 | Levine et al. | |
| 2014/0340242 | A1 | 11/2014 | Belzner et al. | |
| 2015/0161890 | A1* | 6/2015 | Huntzicker | G08G 1/144 340/932.2 |
| 2016/0025503 | A1 | 1/2016 | Kees et al. | |
| 2016/0217510 | A1* | 7/2016 | Brown | G06Q 30/0284 |
| 2016/0371607 | A1* | 12/2016 | Rosen | G06Q 10/02 |
| 2017/0200320 | A1* | 7/2017 | Tomer | G07B 15/00 |
| 2017/0201570 | A1* | 7/2017 | Reber | H04L 67/10 |
| 2017/0270793 | A1* | 9/2017 | Scofield | G08G 1/141 |

FOREIGN PATENT DOCUMENTS

JP H0688456 A 3/1994

OTHER PUBLICATIONS

Reis et al., "Statistics of Parked Cars for Urban Vehicular Networks", Proceedings of the 17th International IEEE Symposium on "A World of Wireless, Mobile and Multimedia Networks", Jun. 2016, 6 Pages.

(Continued)

*Primary Examiner* — Leon-Viet Nguyen
(74) *Attorney, Agent, or Firm* — Ditthavong & Steiner, P.C.

(57) ABSTRACT

An approach is provided for estimation of waiting time to park. The approach involves processing parking data from a parking area to determine a probability that all parking spots in the parking area are occupied. The parking data is collected from one or more parking sensors. The approach also involves building a remaining parking duration model for a plurality of cars parked in said all parking spots based on the parking data. The approach further involves calculating an estimated conditional waiting time to park in the parking area based on the remaining parking duration model. The approach further involves calculating an estimated unconditional waiting time to park in the parking area based on the blocking probability and the conditional waiting time to park.

20 Claims, 14 Drawing Sheets

(56) References Cited

OTHER PUBLICATIONS

Chen et al., "Uncertainty in Urban Mobility: Predicting Waiting Times for Shared Bicycles and Parking Lots", Proceedings of the 16th International IEEE Annual Conference on Intelligent Transportation Systems, Oct. 6-9, 2013, pp. 53-58.
Caliskan et al., "Predicting Parking Lot Occupancy in Vehicular Ad Hoc Networks", IEEE 65th Vehicular Technology Conference—VTC2007-Spring, Apr. 22-25, 2007, 5 Pages.
Brown et al., "Statistical Analysis of a Telephone Call Center: A Queueing-Science Perspective", Journal of the American Statistical Association, vol. 100, No. 469, Mar. 2005, pp. 36-50.

* cited by examiner

METHOD AND APPARATUS FOR ESTIMATION OF WAITING TIME TO PARK

BACKGROUND

Service providers and device manufacturers (e.g., wireless, cellular, etc.) are continually challenged to deliver value and convenience to consumers by, for example, providing compelling network services. One area of interest has been the development of location based services to provide parking guidance information to the users. For example, in areas (e.g., city centers, residential areas, shopping areas, etc.) where parking is limited, finding an available parking space can be difficult and takes time. For example, when a driver encounters on-street parking, parking lots, or other parking areas that are full, the driver can face uncertainty over whether to wait for a potential parking spot to become available or continue to search in other areas where parking may be available.

SOME EXAMPLE EMBODIMENTS

Therefore, to help a driver make an informed choice in such a situation, there is a need for an approach for estimating a waiting time to park.

According to one embodiment, a method comprises processing parking data from a parking area to determine the blocking probability that all parking spots in the parking area are occupied. The method also comprises building a remaining parking duration model for a plurality of cars parked in said all parking spots based on the parking data. The method further comprises predicting/estimating a conditional waiting time to park in the parking area based on the remaining parking duration model. The method further comprises predicting/estimating an unconditional waiting time to park in the parking area based on the blocking probability and the conditional waiting time to park. A user interface of a device is presented to display the conditional and/or unconditional waiting time to park.

According to another embodiment, an apparatus comprises at least one processor, and at least one memory including computer program code for one or more computer programs, the at least one memory and the computer program code configured to, with the at least one processor, cause, at least in part, the apparatus to process parking data from a parking area to determine the blocking probability that all parking spots in the parking area are occupied. The apparatus is also caused to build a remaining parking duration model for a plurality of cars parked in said all parking spots based on the parking data. The apparatus is further caused to predict/estimate a conditional waiting time to park in the parking area based on the remaining parking duration model. The apparatus is further caused to predict/estimate an unconditional waiting time to park in the parking area based on the blocking probability and the conditional waiting time to park. A user interface of a device is presented to display the conditional and/or unconditional waiting time to park.

According to another embodiment, a computer-readable storage medium carries one or more sequences of one or more instructions which, when executed by one or more processors, cause, at least in part, an apparatus to process parking data from a parking area to determine the blocking probability that all parking spots in the parking area are occupied. The apparatus is also caused to build a remaining parking duration model for a plurality of cars parked in said all parking spots based on the parking data. The apparatus is further caused to predict/estimate a conditional waiting time to park in the parking area based on the remaining parking duration model. The apparatus is further caused to predict/estimate an unconditional waiting time to park in the parking area based on the blocking probability and the conditional waiting time to park. A user interface of a device is presented to display the conditional and/or unconditional waiting time to park.

According to another embodiment, an apparatus comprises means for processing parking data from a parking area to determine the blocking probability that all parking spots in the parking area are occupied. The apparatus also comprises means for building a remaining parking duration model for a plurality of cars parked in said all parking spots based on the parking data. The apparatus further comprises means for predicting/estimating a conditional waiting time to park in the parking area based on the remaining parking duration module. The apparatus further comprises means for predicting/estimating an unconditional waiting time to park in the parking area based on the blocking probability and the conditional waiting time to park. A user interface of a device is presented to display the conditional and/or conditional waiting time to park.

According to another embodiment, a method comprises receiving, at a navigation device, a request for a navigation route to a destination. The method also comprises processing parking data from a parking area within a threshold distance of the destination to determine the blocking probability that all parking spots in the parking area are occupied. The method further comprises building a remaining parking duration model for a plurality of cars parked in said all parking spots based on the parking data. The method further comprises predicting/estimating a conditional waiting time to park in the parking area based on the remaining parking duration model. The method further comprises adjusting an estimated time of arrival at the destination based on the blocking probability and the conditional waiting time to park.

According to another embodiment, an apparatus comprises at least one processor, and at least one memory including computer program code for one or more computer programs, the at least one memory and the computer program code configured to, with the at least one processor, cause, at least in part, the apparatus to receive, at a navigation device, a request for a navigation route to a destination. The apparatus is also caused to process parking data from a parking area within a threshold distance of the destination to determine the blocking probability that all parking spots in the parking area are occupied. The apparatus is further caused to build a remaining parking duration model for a plurality of cars parked in said all parking spots based on the parking data. The apparatus is further caused to predict/estimate a conditional waiting time to park in the parking area based on the remaining parking duration model. The apparatus is further caused to adjust an estimated time of arrival at the destination based on the blocking probability and the conditional waiting time to park.

According to another embodiment, a computer-readable storage medium carries one or more sequences of one or more instructions which, when executed by one or more processors, cause, at least in part, an apparatus to receive, at a navigation device, a request for a navigation route to a destination. The apparatus is also caused to process parking data from a parking area within a threshold distance of the destination to determine the blocking probability that all parking spots in the parking area are occupied. The apparatus is further caused to build a remaining parking duration model for a plurality of cars parked in said all parking spots based on the parking data. The apparatus is further caused to predict/estimate a conditional waiting time to park in the parking area based on the average minimum remaining parking duration. The apparatus is further caused to adjust an estimated time of arrival at the destination based on the blocking probability and the conditional waiting time to park.

According to another embodiment, an apparatus comprises means for receiving, at a navigation device, a request for a navigation route to a destination. The apparatus also comprises means for processing parking data from a parking area within a threshold distance of the destination to determine the blocking probability that all parking spots in the parking area are occupied. The apparatus further comprises building a remaining parking duration model for a plurality of cars parked in said all parking spots based on the parking data. The apparatus further comprises predicting/estimating a conditional waiting time to park in the parking area based on the average minimum remaining parking duration. The apparatus further comprises adjusting an estimated time of arrival at the destination based on the blocking probability and the conditional waiting time to park.

In addition, for various example embodiments of the invention, the following is applicable: a method comprising facilitating a processing of and/or processing (1) data and/or (2) information and/or (3) at least one signal, the (1) data and/or (2) information and/or (3) at least one signal based, at least in part, on (or derived at least in part from) any one or any combination of methods (or processes) disclosed in this application as relevant to any embodiment of the invention.

For various example embodiments of the invention, the following is also applicable: a method comprising facilitating access to at least one interface configured to allow access to at least one service, the at least one service configured to perform any one or any combination of network or service provider methods (or processes) disclosed in this application.

For various example embodiments of the invention, the following is also applicable: a method comprising facilitating creating and/or facilitating modifying (1) at least one device user interface element and/or (2) at least one device user interface functionality, the (1) at least one device user interface element and/or (2) at least one device user interface functionality based, at least in part, on data and/or information resulting from one or any combination of methods or processes disclosed in this application as relevant to any embodiment of the invention, and/or at least one signal resulting from one or any combination of methods (or processes) disclosed in this application as relevant to any embodiment of the invention.

For various example embodiments of the invention, the following is also applicable: a method comprising creating and/or modifying (1) at least one device user interface element and/or (2) at least one device user interface functionality, the (1) at least one device user interface element and/or (2) at least one device user interface functionality based at least in part on data and/or information resulting from one or any combination of methods (or processes) disclosed in this application as relevant to any embodiment of the invention, and/or at least one signal resulting from one or any combination of methods (or processes) disclosed in this application as relevant to any embodiment of the invention.

In various example embodiments, the methods (or processes) can be accomplished on the service provider side or on the mobile device side or in any shared way between service provider and mobile device with actions being performed on both sides.

For various example embodiments, the following is applicable: An apparatus comprising means for performing the method of any of the claims.

Still other aspects, features, and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The embodiments of the invention are illustrated by way of example, and not by way of limitation, in the figures of the accompanying drawings.

DESCRIPTION OF SOME EMBODIMENTS

Examples of a method, apparatus, and computer program for providing estimation of a waiting time to park are disclosed. In the following description, for the purposes of explanation, numerous specific details are set forth in order to provide a thorough understanding of the embodiments of the invention. It is apparent, however, to one skilled in the art that the embodiments of the invention may be practiced without these specific details or with an equivalent arrangement. In other instances, well-known structures and devices are shown in block diagram form in order to avoid unnecessarily obscuring the embodiments of the invention.

As discussed above, finding a parking space can be time consuming and frustrating, particularly in city centers or other similar areas where parking spaces may be limited or the number of parkers is high. Historically, navigation systems (e.g., embedded car navigation systems) may offer assistance in these situations by indicating parking facilities (e.g., on-street parking, car parks, parking garages, etc.) that are nearby. The presentation of parking facilities typically is triggered when a driver or user approaches a known or predicted location. However, if all of the parking spots at those parking facilities are occupied by other cars, traditional navigation systems generally offer few alternatives other than to suggest other parking facilities.

Figure 1B:
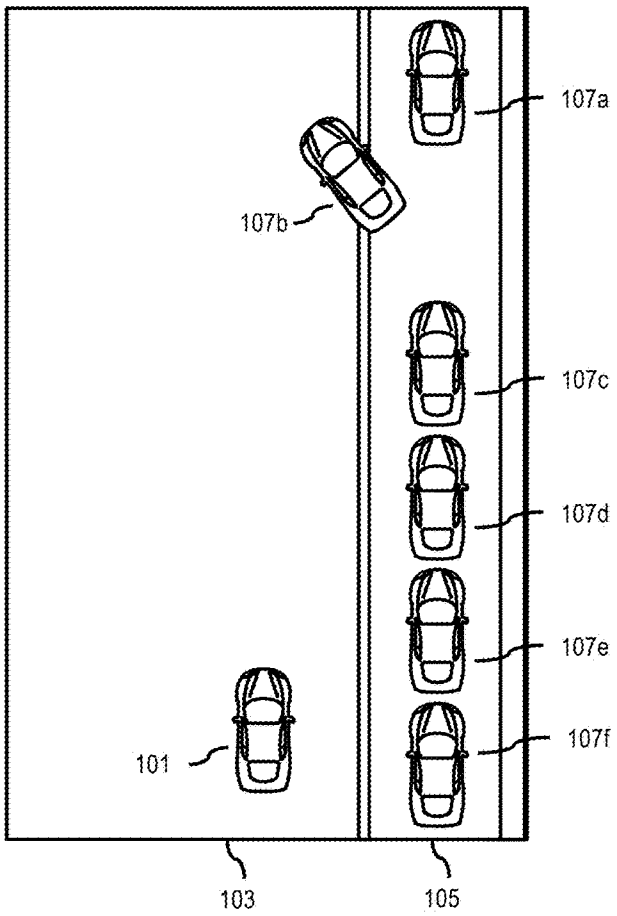
FIGS. 1A-1C are diagrams illustrating example parking areas, according to various embodiments.
Figure 1A:
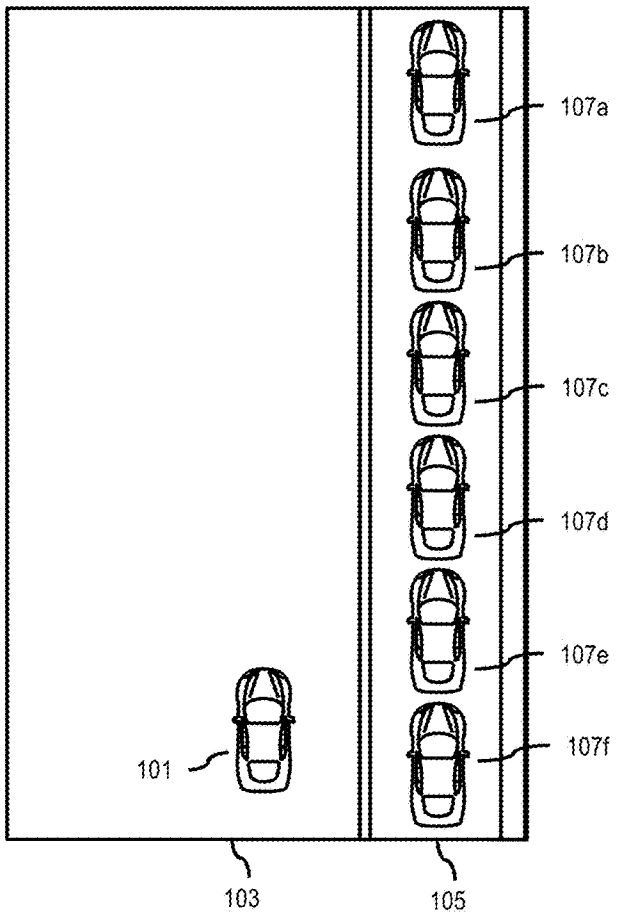
Figure 1C:
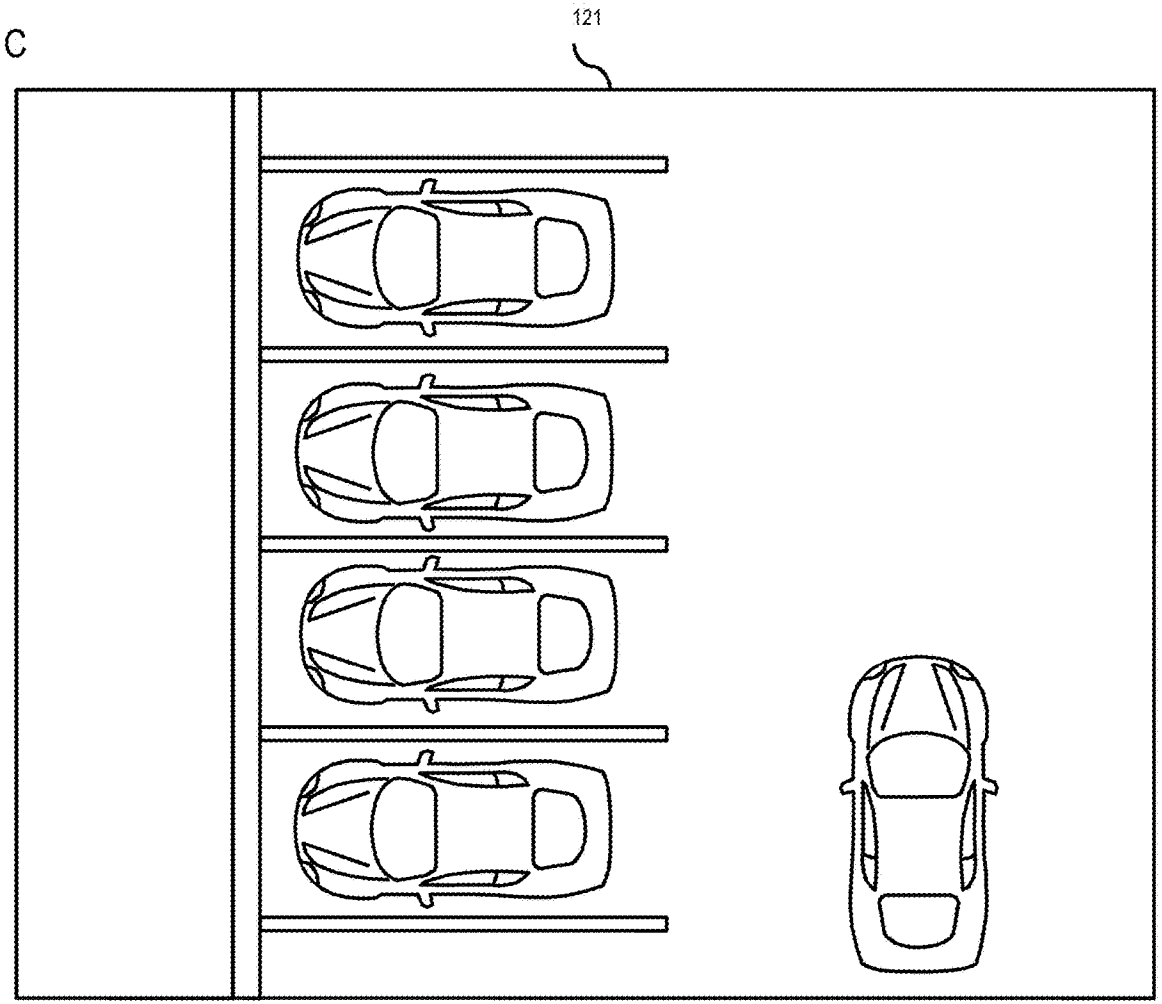

For example, as shown in FIG. 1A, a car 101 comes to a street 103 and looks for parking, but all parking spots in the parking lane 105 of the street 103 are occupied by other cars 107*a*-107*f* In this situation, the driver may want to know the waiting time until any of the parked cars are expected to leave a parking spot (i.e., a conditional waiting time to park). FIG. 1B continues the example of FIG. 1A and depicts a future point in time when one of the parked cars (e.g., other car 107*b*) leaves a parking spot in the parking lane 105. The time period or duration between when the car 101 first comes to the street 103 in FIG. 1A and when the other car 107*b* leaves its parking spot in FIG. 1B is an example of a conditional waiting time to park with respect to the car 101. Although FIGS. 1A and 1B depicts the a conditional waiting time to park example for on-street parking, the problem is not restricted to such a scenario, and can occur in any type of parking area including, but not limited to, a parking lot 121 as shown in FIG. 1C, or other parking garages or facilities. For example, by knowing the waiting time to park for a given parking area, the driver can use this information to decide whether to look elsewhere for parking or taking some other action. Accordingly, service providers face significant technical challenges to estimating a waiting time to park for presentation to a user.

Figure 2:
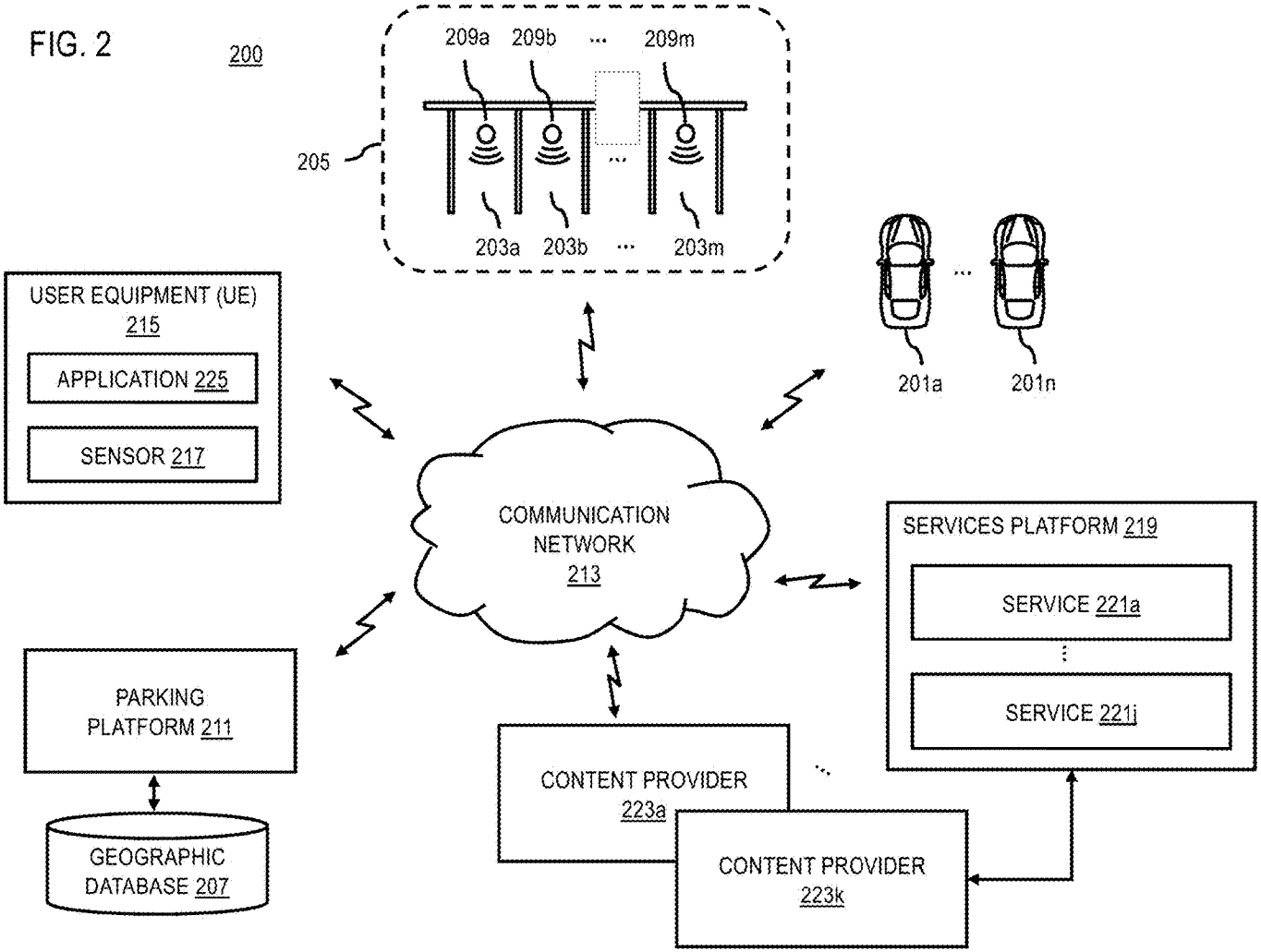
FIG. 2 is a diagram of a system for providing estimation of a waiting time to park, according to one embodiment.

To address this problem, a system 200 of FIG. 2 introduces a capability to predict/estimate a conditional waiting time to park as the average minimum remaining parking duration when all parking spots are occupied in a given parking area (e.g., on-street parking, parking lots, parking garages, etc.). By way of example, the average minimum remaining parking duration can be determined from estimations of the remaining parking durations for all of the parked cars in the occupied parking spots. As noted above, in one embodiment, the remaining parking duration of a parked car at time t is the duration from t to the time the car leaves or is expected to leave a parking spot.

In one embodiment, the system 200 can employ any model or process for estimating the remaining parking duration of cars for use in estimating a waiting time to park. For example, the system 200 can assume that probability distribution models of the remaining parking duration of a car and all cars in the parking area are independent. Accordingly, two example probability distributions include, but are not limited to, an exponential model and a log-normal model. Other potential models include a gamma model, a Nakagami model, etc. The parking duration model can use, for instance but not limited to, parking data collected from the cars parked in the parking areas of interest. By way of example, the parking data can indicate arrival and/or departure times of each respective car or vehicle in a parking spot. The parking data can be collected from sensors in the vehicles and/or in the parking spots. Moreover, the parking data can be historical data. In which case, the estimated waiting time to park would be based on historical data. In addition or alternatively, the parking data can be real-time parking data collected from cars currently parked in a parking area or a combination of both historical and real-time data. In which case, the resulting estimated waiting time to park would be a real-time based estimation.

In one embodiment, the parking data can include observations of all parking events (e.g., parking event and/or leaving event) or a subset of events. If only a subset or partial set of parking events are available in the parking data, then then system 200 can estimate the complete set from the partial set. For example, the system 200 can extrapolate from the partial set to the complete set or use any other equivalent means to estimate a complete set from the partial set of parking event data.

In one embodiment, the system 200 uses the output parameters from the parking duration model (e.g., parking duration, remaining parking duration, etc.) to calculate a cumulative distribution function (CDF) of the minimum remaining parking duration for a given number of parking spots in the parking area (e.g., k spots). The system 200 can then determine a probability density function (PDF) of the minimum remaining parking duration for the k parking spots by taking a derivative of the CDF. Then, the system 200 defines the conditional waiting time to park as the average minimum remaining parking duration when all parking spots in the parking area (e.g., n spots, so that k=n) are occupied. In other words, in one embodiment, the conditional waiting to park is based on the condition that all parking spots in the parking area are occupied. Accordingly, the conditional waiting time to park can be estimated by setting k=n when calculating the PDF and CDF (embodiments of this process are discussed in more detail below with respect to FIGS. 5 and 6).

As shown in FIG. 2, the system 200 comprises one or more vehicles 201*a*-201*n* (e.g., also collectively referred to as vehicles 201), such as but not limited to cars, that can park in one or more parking spaces 203*a*-203*m* (also collectively referred to as parking spaces 203) within a parking area 205. By way of example, the parking area 205 can include on-street parking associated with one or more travel segments or links mapped in a geographic database 207. In addition or alternatively, the parking area 205 can be parking lots, garages, or other parking facilities mapped in the geographic database 207.

In one embodiment, each of the parking spaces 203 can be respectively equipped with parking sensors 209*a*-209*m* (also collectively referred to as parking sensors 209) for detecting when a car 201 parks or leaves each space 203. The sensors 209 can be any type of sensor capable of detecting a vehicle 201 parking in or leaving a parking space 203 (e.g., embedded magnetic sensors, imaging sensors, etc.), and then storing or transmitting the collected sensor data as parking data. In addition or alternatively, each vehicle 201 can be equipped with sensors (e.g., location sensors) that can also detect when the vehicle 201 parks in or leaves a parking space 203, for storage or transmission as parking data.

In one embodiment, the parking data collected by the parking sensors 209 and/or the vehicles 201 can be transmitted to the parking platform 211 over a communication network 213. The parking platform 211 performs the functions associated with providing an estimation of a waiting time to park according to the various embodiments described herein (e.g., by estimating the waiting to park based on a calculated minimum average remaining parking duration of the vehicles 201 in the parking area 205).

In yet another embodiment, the parking data is collected from vehicles 201 as probe or trajectory data (e.g., location traces indicating heading, speed, location, time, and/or other vehicle telemetry data). The trajectory data then can be processed to build the remaining parking duration model and estimate parking availability (e.g., estimate the blocking probability or probability to park). For example, for each journey extracted from vehicle trajectory data collected from vehicles (e.g., cars) traveling in a road or travel network, the system 200 identifies at least one point in the journey when a vehicle 201 initiates a parking search. The system 200 then classifies all street segments between the point where the driver started searching for parking and the end of the journey as full or not available for parking.

In one embodiment, a user equipment device (UE) 215 can be used to collect and/or process parking data for building the remaining parking duration mode for estimating a waiting time to park. For example, the UE 215 can be a standalone device (e.g., mobile phone, portable navigation device, wearable device, etc.) or installed/embedded in the vehicle 201. In one embodiment, the UE 215 (and/or the vehicle 201) may be configured with one or more sensors 217 for determining parking data. By way of example, the sensors 217 may include location sensors (e.g., GPS), accelerometers, compass sensors, gyroscopes, altimeters, etc. In one embodiment, the sensors 217 can also be used to detect and report status data about an operational state of the vehicle 201 to assist in determining when a vehicle 201 parks in or leaves a parking space 203. For example, a parking event may be detected when it is determined that a vehicle's is engine off, the key is outside of the car, the vehicle door is locked, and/or the like. These detected parking events (e.g., when a car parks or leaves a parking space) are then used to calculate parking durations from which the remaining parking duration model can be built.

In one embodiment, the parking platform 211 is configured with a list of parking areas 205 and/or streets/travel segments within these areas that are to be monitored for parking availability information, and for calculating an estimated waiting time for those areas when the parking availability information indicates that all parking spaces 203 in those areas are occupied. In addition, the parking platform 211 may have access to information about the number of parking spaces 203 in each of the parking areas 205. In one embodiment, information on the parking areas 205, the travel segments, the number of parking spaces 203, and/or related information are stored in the geographic database 207. In addition or alternatively, the parking data or information can be provided by a service platform 219, one or more services 221*a*-221*j* (also collectively referred to as services 221), one or more content providers 223*a*-223*k* (also collectively referred to as content providers 223), or a combination thereof. For example, the sources of the information may include map data and related parking data collected from the vehicles 201 and/or parking sensors 209.

In one embodiment, when a vehicle 201 and/or UE 215 (e.g., via a navigation system, application 225, and/or the like) requests instructions to find parking in a given area or location, the parking platform 211 can predict/estimate the probability that parking in the area is fully occupied. The parking platform 211 can predict/estimate a conditional waiting time for the area or other nearby parking areas 205 assuming that parking in the target area is fully occupied. In one embodiment, the parking platform 211 can present the estimated waiting time to park in a user interface of the requesting vehicle 201 or UE 215. In other embodiments, the estimated waiting time to park can be used to suggest a parking location near the destination (e.g., routing to a nearest parking area to the user's destination with the least amount of waiting time to park), or provide a better estimated time of arrival (ETA) at a given destination (e.g., by adjusting the ETA to include the waiting time to park).

In one embodiment, the parking platform 103 may also send the estimated waiting time to park information as a map overlay that illustrates, for instance, the waiting times to park along various travel segments with on-street parking or parking facilities visible in a mapping user interface of the vehicle 201 and/or UE 215. This mode of operation may be used, for instance, when a precise target destination of the vehicle 201 or UE 215 is not known, or when the driver wants to assess waiting times to park within a general area.

In one embodiment, as noted above, the vehicles 201 are equipped with an embedded navigation systems or other navigation devices (e.g., a UE 215) that are capable of submitting requests for parking information (e.g., estimated waiting times to park, parking availability, parking and leaving events, etc.), and of guiding a driver of the vehicle 201 along a navigation route using the parking information. In one embodiment, as the driver navigates along the received route, the vehicles 201 and/or UE 215 (e.g., via a navigation application 225) may receive real-time updates on waiting times to park at parking areas 205 near a destination of the navigation route (e.g., parking areas within a threshold distance of the destination).

In one embodiment, requests for parking instructions or information (e.g., waiting times to park) can be triggered by interactions with a user interface of the vehicle 201 and/or UE 215 (e.g., an explicit request from a user or driver), or automatically when the driver or vehicle 201 approaches a target destination (e.g., a set destination, an inferred destination, and/or any other known destination). In yet another embodiment, the vehicle 201 and/or UE 215 can initiate a request for waiting times to park when the vehicle 201 is detected to have initiated a parking search (e.g., by creating location traces or trajectory data indicating circling, slowing down, multiple U-turns, etc. within an area of the destination). In this way, the estimated waiting time to park can be provided even when no destination is set or known by the system 200.

As described in the various embodiments, the parking platform 211 operates in connection with one or more vehicles 201 and/or UEs 215 for estimating a waiting time to park based a calculated average minimum remaining parking duration for vehicles 201 parked in a parking area 205. By way of example, the UE 215 may be any mobile computer including, but not limited to, an in-vehicle navigation system, vehicle telemetry device or sensor, a personal navigation device ("PND"), a portable navigation device, a cellular telephone, a mobile phone, a personal digital assistant ("PDA"), a wearable device, a camera, a computer and/or other device that can perform navigation or location based functions, i.e., digital routing and map display. In some embodiments, it is contemplated that mobile computer can refer to a combination of devices such as a cellular telephone that is interfaced with an on-board navigation system of the vehicle 201 (e.g., an autonomous vehicle or highly assisted driving vehicle) or physically connected to the vehicle 201 for serving as the navigation system. Also, the vehicles 201, parking sensors 209, and UEs 215 may be configured to access a communication network 213 by way of any known or still developing communication protocols.

Also, as noted above, the vehicles 201 may include navigation systems and/or the UEs 215 may be configured with navigation applications 225 for interacting with one or more content providers 223, services 221 of a service platform 219, or a combination thereof. Per these services, the navigation systems or applications 225 may acquire parking information (e.g., estimated waiting to parking, parking duration information, etc.), parking location instructions, navigation information, location information, mapping information and other data associated with the current location of the vehicle 201 or UE 215, a direction or movement of the vehicle 201 or UE 215 along a roadway, etc.

By way of example, the parking platform 211 may be implemented as a cloud based service, hosted solution or the like for performing the above described functions. Alternatively, the parking platform 211 may be directly integrated for processing data generated and/or provided by one or more services 221, content providers 223, applications 225, and/or navigation systems of the vehicles 201. Per this integration, the parking platform 211 may perform client-side estimating of waiting times to park based on the average minimum remaining parking durations calculated from historical and/or real-time parking data according to the various embodiments described herein.

Although various embodiments are described based on providing a waiting to park, it is contemplated that the embodiments are also applicable to any service queuing scenario. In other words, the process used to calculate a waiting time to park can be generalized to calculating a waiting time to perform any activity or service for which there is a limited number of spots that are occupied for a duration of time. When these service spots are all occupied then the waiting time to perform or access those services can be estimated using a minimum average remaining duration of others using the service or activity spot.

By way of example, the communication network 213 of system 200 includes one or more networks such as a data network, a wireless network, a telephony network, or any combination thereof. It is contemplated that the data network may be any local area network (LAN), metropolitan area network (MAN), wide area network (WAN), a public data network (e.g., the Internet), short range wireless network, or any other suitable packet-switched network, such as a commercially owned, proprietary packet-switched network, e.g., a proprietary cable or fiber-optic network, and the like, or any combination thereof. In addition, the wireless network may be, for example, a cellular network and may employ various technologies including enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., worldwide interoperability for microwave access (WiMAX), Long Term Evolution (LTE) networks, code division multiple access (CDMA), wideband code division multiple access (WCDMA), wireless fidelity (WiFi), wireless LAN (WLAN), Bluetooth®, Internet Protocol (IP) data casting, satellite, mobile ad-hoc network (MANET), and the like, or any combination thereof.

By way of example, the vehicles 201, parking sensors 209, UEs 215, and the parking platform 211 communicate with each other and other components of the system 200 using well known, new or still developing protocols. In this context, a protocol includes a set of rules defining how the network nodes within the communication network 213 interact with each other based on information sent over the communication links. The protocols are effective at different layers of operation within each node, from generating and receiving physical signals of various types, to selecting a link for transferring those signals, to the format of information indicated by those signals, to identifying which software application executing on a computer system sends or receives the information. The conceptually different layers of protocols for exchanging information over a network are described in the Open Systems Interconnection (OSI) Reference Model.

Communications between the network nodes are typically effected by exchanging discrete packets of data. Each packet typically comprises (1) header information associated with a particular protocol, and (2) payload information that follows the header information and contains information that may be processed independently of that particular protocol. In some protocols, the packet includes (3) trailer information following the payload and indicating the end of the payload information. The header includes information such as the source of the packet, its destination, the length of the payload, and other properties used by the protocol. Often, the data in the payload for the particular protocol includes a header and payload for a different protocol associated with a different, higher layer of the OSI Reference Model. The header for a particular protocol typically indicates a type for the next protocol contained in its payload. The higher layer protocol is said to be encapsulated in the lower layer protocol. The headers included in a packet traversing multiple heterogeneous networks, such as the Internet, typically include a physical (layer 1) header, a data-link (layer 2) header, an internetwork (layer 3) header and a transport (layer 4) header, and various application (layer 5, layer 6 and layer 7) headers as defined by the OSI Reference Model.

Figure 3:
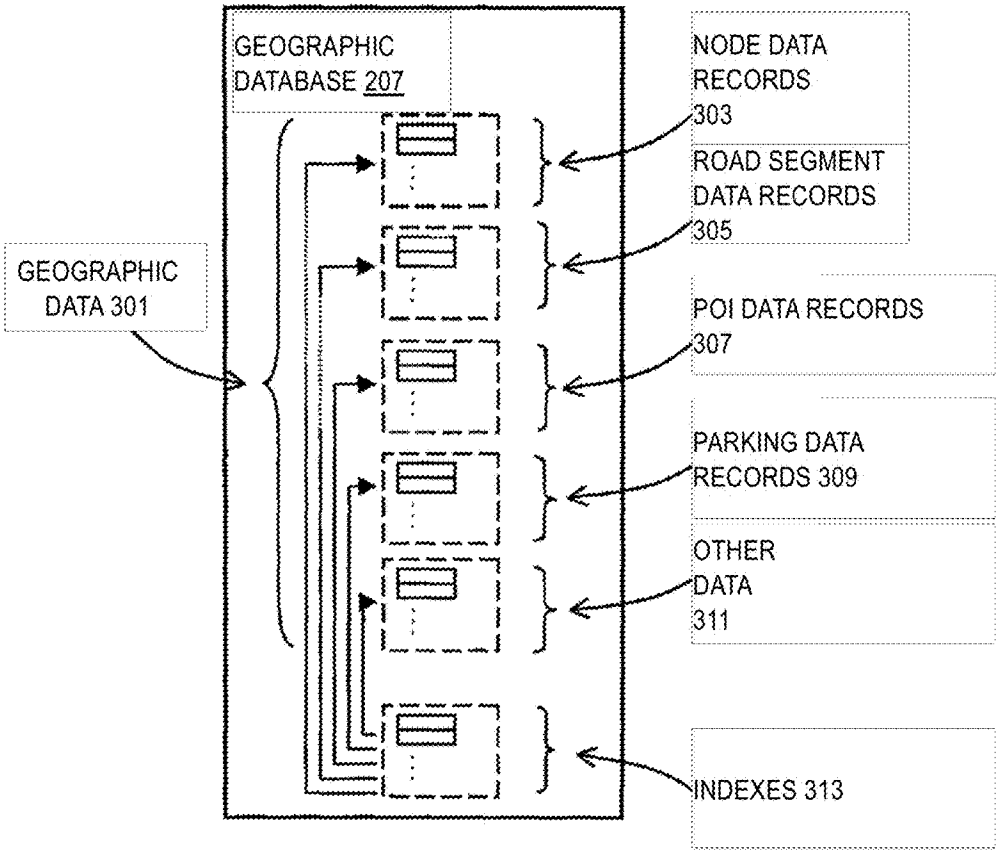
FIG. 3 is a diagram of a geographic database, according to one embodiment.

FIG. 3 is a diagram of the geographic database 207, according to one embodiment. In one embodiment, estimated waiting times to park, parking availability information, and/or any other information used or generated by the system 200 with respect to providing an estimated waiting time to park can be stored, associated with, and/or linked to the geographic database 207 or data thereof. In one embodiment, the geographic or map database 207 includes geographic data 301 used for (or configured to be compiled to be used for) mapping and/or navigation-related services, such as for route information, service information, estimated time of arrival information, location sharing information, speed sharing information, and/or geospatial information sharing, according to exemplary embodiments. For example, the geographic database 207 includes node data records 303, road segment or link data records 305, POI data records 307, parking data records 309, other data records 311, and indexes 313, for example. More, fewer or different data records can be provided.

In one embodiment, the other data records 311 include cartographic ("carto") data records, routing data, and maneuver data. One or more portions, components, areas, layers, features, text, and/or symbols of the POI or event data can be stored in, linked to, and/or associated with one or more of these data records. For example, one or more portions of the POI, event data, or recorded route information can be matched with respective map or geographic records via position or GPS data associations (such as using known or future map matching or geo-coding techniques), for example.

In one embodiment, the indexes 313 may improve the speed of data retrieval operations in the geographic database 207. In one embodiment, the indexes 313 may be used to quickly locate data without having to search every row in the geographic database 207 every time it is accessed.

In exemplary embodiments, the road segment data records 305 are links or segments representing roads, streets, or paths, as can be used in the calculated route or recorded route information. The node data records 303 are end points corresponding to the respective links or segments of the road segment data records 305. The road link data records 305 and the node data records 303 represent a road network, such as used by vehicles, cars, and/or other entities. Alternatively, the geographic database 207 can contain path segment and node data records or other data that represent pedestrian paths or areas in addition to or instead of the vehicle road record data, for example.

The road link and nodes can be associated with attributes, such as geographic coordinates, street names, address ranges, speed limits, turn restrictions at intersections, and other navigation related attributes, as well as POIs, such as traffic controls (e.g., stoplights, stop signs, crossings, etc.), gasoline stations, hotels, restaurants, museums, stadiums, offices, automobile dealerships, auto repair shops, buildings, stores, parks, etc. The geographic database 207 can include data about the POIs and their respective locations in the POI data records 307. The geographic database 207 can also include data about places, such as cities, towns, or other communities, and other geographic features, such as bodies of water, mountain ranges, etc. Such place or feature data can be part of the POI data 307 or can be associated with POIs or POI data records 307 (such as a data point used for displaying or representing a position of a city).

In one embodiment, the parking availability data records 309 can include any data item used by the parking platform 211 including, but not limited to parking duration model data, parking data, estimated waiting times to park for parking areas of interest, travel segments within the parking areas to monitor, number of spaces, parking availability information, timestamp information for the parking availability information, fluctuation information about the parking availability information, parking search behaviors, trajectory data, travel profile information, user preferences, parking events, leaving events, and/or the like.

The geographic database 207 can be maintained by the content provider in association with the service platform 219 (e.g., a map developer). The map developer can collect geographic data 301 to generate and enhance the geographic database 207. There can be different ways used by the map developer to collect data. These ways can include obtaining data from other sources, such as municipalities or respective geographic authorities. In addition, the map developer can employ field personnel to travel by vehicle along roads throughout the geographic region to observe features and/or record information about them, for example. Also, remote sensing, such as aerial or satellite photography, can be used.

The geographic database 207 can be a master geographic database stored in a format that facilitates updating, maintenance, and development. For example, the master geographic database 207 or data 301 in the master geographic database 207 can be in an Oracle spatial format or other spatial format, such as for development or production purposes. The Oracle spatial format or development/production database can be compiled into a delivery format, such as a geographic data files (GDF) format. The data in the production and/or delivery formats can be compiled or further compiled to form geographic database products or databases, which can be used in end user navigation devices or systems (e.g., associated with the vehicles 201 and/or UE 215).

For example, geographic data 301 or geospatial information is compiled (such as into a platform specification format (PSF) format) to organize and/or configure the data for performing map or navigation-related functions and/or services, such as map annotation, route calculation, route guidance, map display, speed calculation, distance and travel time functions, and other functions, by a navigation device, such as by a UE 215 (e.g., via a navigation application 225), for example. The navigation-related functions can correspond to vehicle navigation, pedestrian navigation, or other types of navigation. The compilation to produce the end user databases can be performed by a party or entity separate from the map developer. For example, a customer of the map developer, such as a navigation device developer or other end user device developer, can perform compilation on a received geographic database in a delivery format to produce one or more compiled navigation databases.

As mentioned above, the geographic database 207 can be a master geographic database, but in alternate embodiments, the geographic database 207 can represent a compiled navigation database that can be used in or with end user devices (e.g., the vehicles 201 and/or UEs 215) to provide navigation-related functions including estimations of parking availability and waiting times to park in various parking areas. For example, the geographic database 207 can be used with the end user device (e.g., vehicle 201 and/or UE 215) to provide an end user with navigation features. In such a case, the geographic database 207 and/or its related parking data/information can be downloaded or stored on the end user device, or the end user device can access the geographic database 207 through a wireless or wired connection (such as via a server and/or the communication network 213), for example.

FIG. 3 is a diagram of the components of a parking platform 211, according to one embodiment. By way of example, the parking platform 211 includes one or more components for providing an estimated waiting time to park according to the various embodiments described herein. It is contemplated that the functions of these components may be combined or performed by other components of equivalent functionality. In this embodiment, the parking platform 211 includes a parking data module 401, a waiting time module 403, a routing module 405, and a user interface module 407. The above presented modules and components of the parking platform 211 can be implemented in hardware, firmware, software, or a combination thereof. Though depicted as a separate entity in FIG. 2, it is contemplated that the parking platform 211 may be implemented as a module of any of the components of the system 200 (e.g., a component of the vehicle 201, navigation system of the vehicle 201, UE 215, and/or application 225). In another embodiment, one or more of the modules 401-407 may be implemented as a cloud based service, local service, native application, or combination thereof. The functions of these modules are discussed with respect to FIGS. 5A, 5B, and 6 below.

Figure 4:
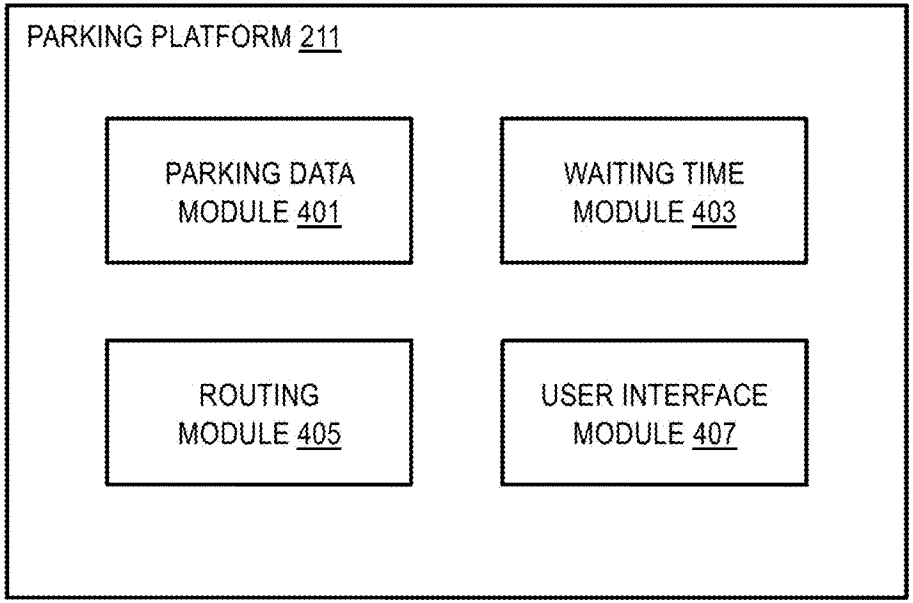
FIG. 4 is a diagram of the components of a parking platform, according to one embodiment.
Figure 5A:
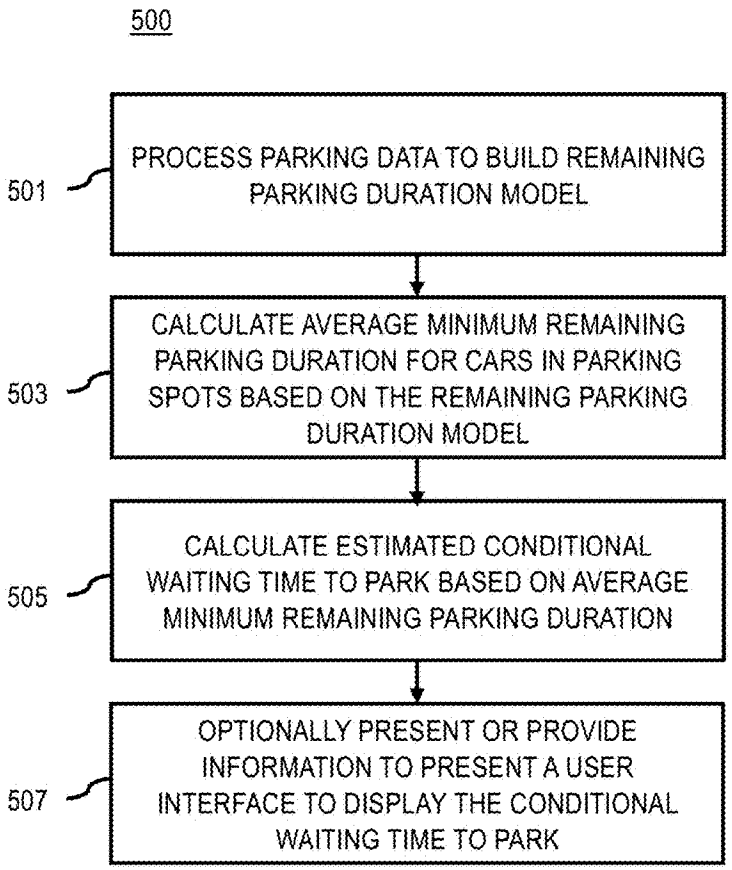
FIG. 5A is a flowchart of a process for predicting/estimating a conditional waiting time to park, according to one embodiment.
Figure 9:
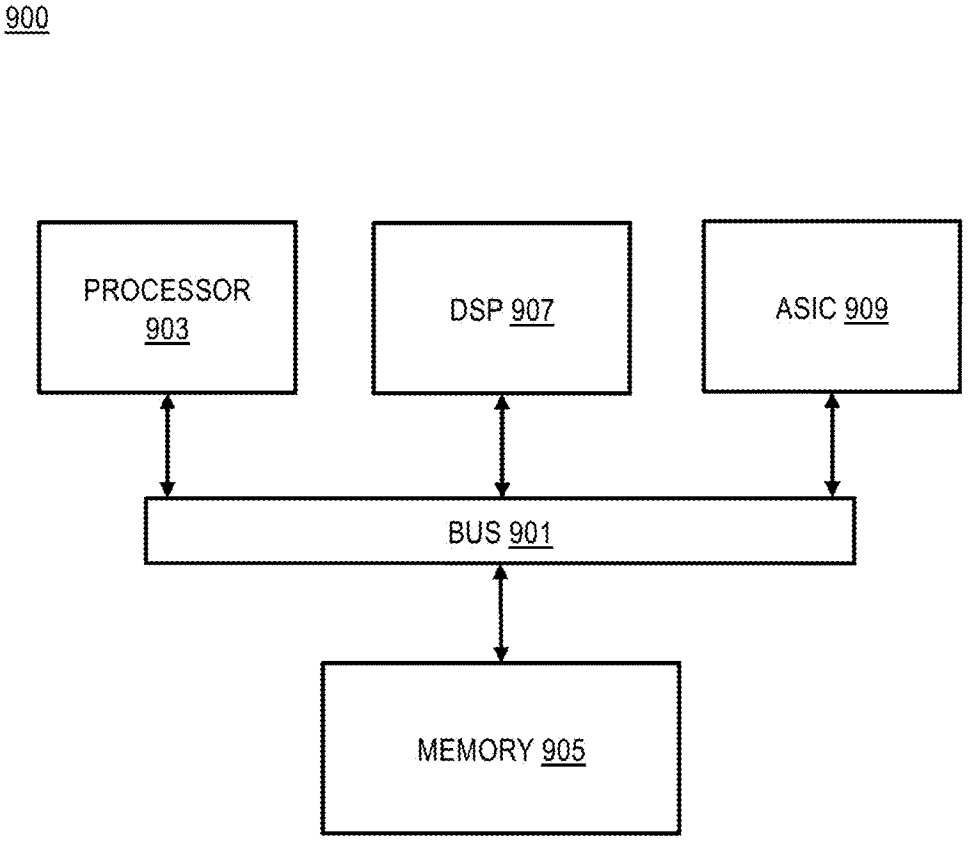
FIG. 9 is a diagram of a chip set that can be used to implement an embodiment.

FIG. 5A is a flowchart of a process for providing estimation of a waiting time to park, according to one embodiment. In various embodiments, the parking platform 211 and/or any of the modules 401-407 of the parking platform 211 as shown in FIG. 4 may perform one or more portions of the process 500 and may be implemented in, for instance, a chip set including a processor and a memory as shown in FIG. 9. As such, the parking platform 211 and/or any of the modules 401-407 can provide means for accomplishing various parts of the process 500, as well as means for accomplishing embodiments of other processes described herein in conjunction with other components of the system 200. Although the process 500 is illustrated and described as a sequence of steps, its contemplated that various embodiments of the process 500 may be performed in any order or combination and need not include all of the illustrated steps.

In step 501, the parking data module 401 processes historical parking data from a parking area (which is not necessary to be the same area as the target parking area) to build a model for the remaining parking duration of a car.

The remaining parking duration model, for instance, can be used to predict an average remaining parking duration for cars parked in a parking area at a specified time. In one embodiment, as previously described, the parking data is collected from one or more parking sensors. By way of example, the one or more parking sensors include one or more embedded sensors in the parking area (e.g., parking sensors 209), one or more vehicle sensors of a plurality of cars (e.g., vehicles 201) parked in said all parking spots, or a combination thereof. The parking data, for instance, may include a time when a vehicle 201 parks in a parking space (e.g., a parking start time), and a time when the vehicle 201 leaves the parking space (e.g., a parking end time). The difference between the parking start time and the parking end time is the parking duration for the vehicle 201. The remaining parking duration of the vehicle 201 decreases from the parking duration to zero as time elapses from the parking start time to the parking end time.

In one embodiment, the parking data can be historical parking data and/or real-time data. For example, parking data that is collected in real-time from a plurality of vehicles parking in the parking area can be used by the parking platform 211 to provide the estimated waiting time to park as a real-time estimation to reflect real-time conditions. In the real-time case, the parking platform 211 can, for instance, specify a period of time from the current time that is to be considered as real-time. For example, the parking data module 401 can process parking from the last 1 hour, 6 hours, 1 day, or whatever the specified "real-time" period is to calculate the real-time estimated waiting time to park. In other words, the real-time estimation can favor parking duration distributions extracted from parking data collected from a more recent period of time to calculate the waiting time to park, thereby potentially capturing more recent parking trends within a given parking area. For example, such real-time waiting estimations can more quickly capture changes in parking habits occurring in response to new events (e.g., new store, attraction, or other point of interest opening near a parking area).

In an embodiment where historical parking data (e.g., including parking data beyond the specified real-time period) are collected, the resulting estimated waiting time to park can reflect parking duration distributions over longer periods of time. Such historical-based estimations can potentially provide more accurate estimations (e.g., because more parking data would be available) when parking conditions or durations are relatively stable over long periods of times.

In one embodiment, the parking data can also be associated with different contextual parameters (e.g., time of day, day of week, season of year, weather condition, nearby points of interest, etc.) that can potentially affect parking duration. For example, parking durations near parks may increase during sunny weather, and decrease during rainy weather. Accordingly, in one embodiment, the parking platform 211 can calculate different waiting times to park for different contexts as indicated by the contextual parameters.

In step 503, the waiting time module 403 calculates an average minimum remaining parking duration for a plurality of cars parked in said all parking spots based on the remaining parking duration model created above to initiate the process for predicting or estimating the conditional waiting time to park (i.e., conditioned on a parking area being fully occupied). In one embodiment, the waiting time module 403 can also calculate an unconditional waiting time to park that is not conditioned on the parking area being fully. Instead, when calculating an unconditional waiting time to park, the parking area can have a probability of being fully occupied (i.e., a blocking probability) or a probability of having parking availability (i.e., a probability to park). The unconditional waiting time to park is then computed based on the conditional waiting time to park and either the blocking probability or the probability to park. The calculation of the conditional and/or unconditional waiting time to park may be initiated by a request (e.g., a routing or parking request) or the arrival of new parking data (e.g., data that can be used to update of the remaining parking duration model).

In one embodiment, the calculation of the average minimum remaining parking duration and the resulting estimated waiting time to park are described using the notation below (it is noted that this notation is provided by way of illustration and not limitation, and therefore, any equivalent notation may be used):

The total number of parking spots in a parking area (e.g., a street segment, parking lot, parking garage, etc.), n;

The probability density function (PDF) of a car's remaining parking duration, $f(x)=f(X=x)$, $x\geq 0$;

The cumulative distribution function (CDF) of a car's remaining parking duration, $$F(x) = F(X \leq x) = \int_0^x f(X = t)dt,\ x > 0;$$

The average remaining parking duration of a car, $$d = E\{X\} = \int_0^\infty x f(x)dx;$$

The minimum remaining parking duration when k parking spots are occupied, $Y=\min_{i=1,\ldots,k} X_i$, $k\leq n$; and The conditional waiting time to park $\tau$ is defined as the average minimum remaining parking duration conditioned on that all parking spots on the street are occupied, i.e., $$\tau = E\{Y \mid k = n\} = \int_0^\infty x f(Y = x \mid k = n)dx.$$

The blocking probability of a parking area, i.e., the probability that all parking spots in the parking area are occupied, is b.

The unconditional waiting time to park $\tau_u$ is defined as the average minimum remaining parking duration, i.e., $\tau_u=(1-b)\cdot 0+b\tau=b\tau$.

Under this notation, the functions $f(x)$ and $F(x)$ represent different potential models for estimating parking duration from parking data. It is contemplated that any parking duration model can be used according to the various embodiments described herein. Examples of these parking duration models are discussed in more detail below.

In one embodiment, the waiting time module 403 calculates a remaining parking duration at a specified time for each of the plurality of cars from the parking data. The remaining parking duration is a duration from the specified time to when said each of the plurality of cars leaves one of said all parking spots. Then, the average minimum remaining parking duration is based on the remaining parking duration for said each of the plurality of cars. Generally, depending on the specified time when a car approaches a parking area, the remaining parking duration can vary. For example, at a parking area near a restaurant, a car waiting to park near lunch time may encounter a shorter waiting time to park relative to approaching the same parking area at dinner time assuming the parking area is fully occupied at both times, because people tend to stay at the restaurant for shorter durations at lunch than at dinner.

Therefore, in one embodiment, the calculation of the waiting time to park can be approached probabilistically. For example, the probabilistic problem is that given an observed distribution of parking durations for all or substantially parking spaces in a parking area, what is the waiting time to park if a car comes and finds that the parking area is all occupied (i.e., what is the waiting time until any of the parked cars in the parking area leaves?)?

One embodiment of a general approach to address this problem is provided below. This general approach provides processes in which different parking duration models (e.g., functions $f(x)$ and $F(x)$) can be substituted as indicated. For example, in one embodiment, the waiting time module 403 begins this approach by calculating a cumulative distribution function of the remaining parking duration for said each of the plurality of cars.

More specifically, given the CDF of the i-th car's remaining parking duration as $F(X_i<x)$, the CDF of the minimum remaining parking duration $Y=X_i$ is:

$$F(Y\leq x|k)=F(\min_{i=1,\ldots,k}X_i\leq x|k)=1-[1-F(x)]^k \quad (1)$$

The waiting time module 403 then calculates a probability density function of the remaining parking duration for said each of the plurality of cars from the cumulative distribution function. The corresponding PDF of the minimum remaining parking duration, for instance, is simply a derivative of the CDF:

$$\begin{aligned} f(Y|k)&=f(\min_{i=1,\ldots,k}X_i=x|k)=F'(\min_{i=1,\ldots,k}X_i<x|k)\\ &=kf(x)[1-F(x)]^{k-1} \end{aligned} \quad (2)$$

The average minimum remaining parking duration is based on the probability density function.

Accordingly, in step 505, the waiting time module 403 calculates an estimated conditional waiting time to park in the parking area as the average minimum remaining parking duration conditioned on that the parking area is fully occupied.

Therefore, the estimated conditional waiting time to park $\tau$ is:

$$\tau = E\{Y \mid k=n\} = \int_0^\infty xf(Y=x \mid k=n)dx = \int_0^\infty nxf(x)[1-F(x)]^{n-1}dx \quad (3)$$

As noted above, the above approach includes functions $f(x)$ and $F(x)$ which represent parking duration models that can be substituted into the equations (1)-(3) above to link the approach to parking data input. In other words, the remaining parking duration is calculated by applying a parking duration model to the parking data for input into the general approach. By way of example, the parking duration model can be an exponential model, a log-normal model, or a combination thereof. The exponential model and log-normal models are provided only to illustrate possible examples of a parking duration model, and are not intended as limitations. It is contemplated that any equivalent parking duration model that can output remaining parking duration data from collected parking data can be used according to the various embodiments described herein.

In one embodiment, the waiting time module 403 can use an exponential model to calculate a remaining parking time duration. By way of example, the exponential model uses an exponential probability distribution that describes the remaining parking duration of a parked car, i.e. at a specific time t the difference between t and the parked car leaves.

In other words, the remaining parking duration can be modeled as an exponential distribution according to the following:

$$f(x)=f(X=x)=\mu e^{-\mu x} \quad (1)$$

and $$F(x)=F(X\leq x)=1-e^{-\mu x} \quad (2)$$

where $\mu$ is the rate parameter which can be determined from the collected parking data.

In one embodiment, the rate parameter $\mu$ is determined from the average remaining parking duration d as $$\mu = \frac{1}{d} \quad (3)$$

Substituting Equations (1), $$(2) \text{ and } \mu = \frac{1}{d}$$

(3) into Equation (3)

$$\tau = E\{Y \mid k=n\} = \int_0^\infty xf(=x \mid k=n)dx = \int_n^\infty nxf(x)[1-F(x)]^{n-1}dx$$

of the general approach, the estimated waiting time to park under the exponential model is:

$$\tau = \frac{1}{n\mu} = \frac{1}{n}d \quad (7)$$

In yet another embodiment, the waiting time module 403 can use a log-normal as the parking duration model. By way of example, a log-normal distribution is a continuous probability distribution of a random variable. Therefore, the remaining parking duration can also be modeled as a log-normal distribution according to one embodiment:

$$f(x) = f(X=x) = \frac{1}{x\sigma\sqrt{2\pi}}e^{-\frac{(\ln x-\mu)^2}{2\sigma^2}} \quad (4)$$

and $$F(x) = F(X \leq x) = \frac{1}{2}\text{erfc}\left(-\frac{\ln x-\mu}{\sigma\sqrt{2}}\right) \quad (5)$$

where $\mu$ and $\sigma>0$ are the mean and standard deviation of the remaining parking duration's natural logarithm as determined from the collected parking data, and where erfc(x) is the complementary error function.

In this embodiment, the average remaining parking duration d is:

$$d = e^{\mu+\frac{1}{2}\sigma^2} \tag{6}$$

Substituting Equations (4), (5) and (6) into Equation (3)

$$\tau = E\{Y \mid k = n\} = \int_0^\infty xf(=x \mid k = n)dx = \int_n^\infty nxf(x)[1 - F(x)]^{n-1}dx$$

of the general approach, the conditional time to park under the log-normal model is:

$$\tau = \frac{n}{\sigma 2^n}\sqrt{\frac{2}{\pi}}\int_0^\infty e^{-\frac{(\ln x-\mu)^2}{2\sigma^2}}\left[erfc\left(\frac{\ln x-\mu}{\sigma\sqrt{2}}\right)\right]^{n-1}dx = \frac{nd}{2^{n-1}\sqrt{\pi}}\int_{-\infty}^\infty e^{-x^2}\left[erfc\left(x+\frac{\sigma}{\sqrt{2}}\right)\right]^{n-1}dx \tag{7}$$

Figure 5B:
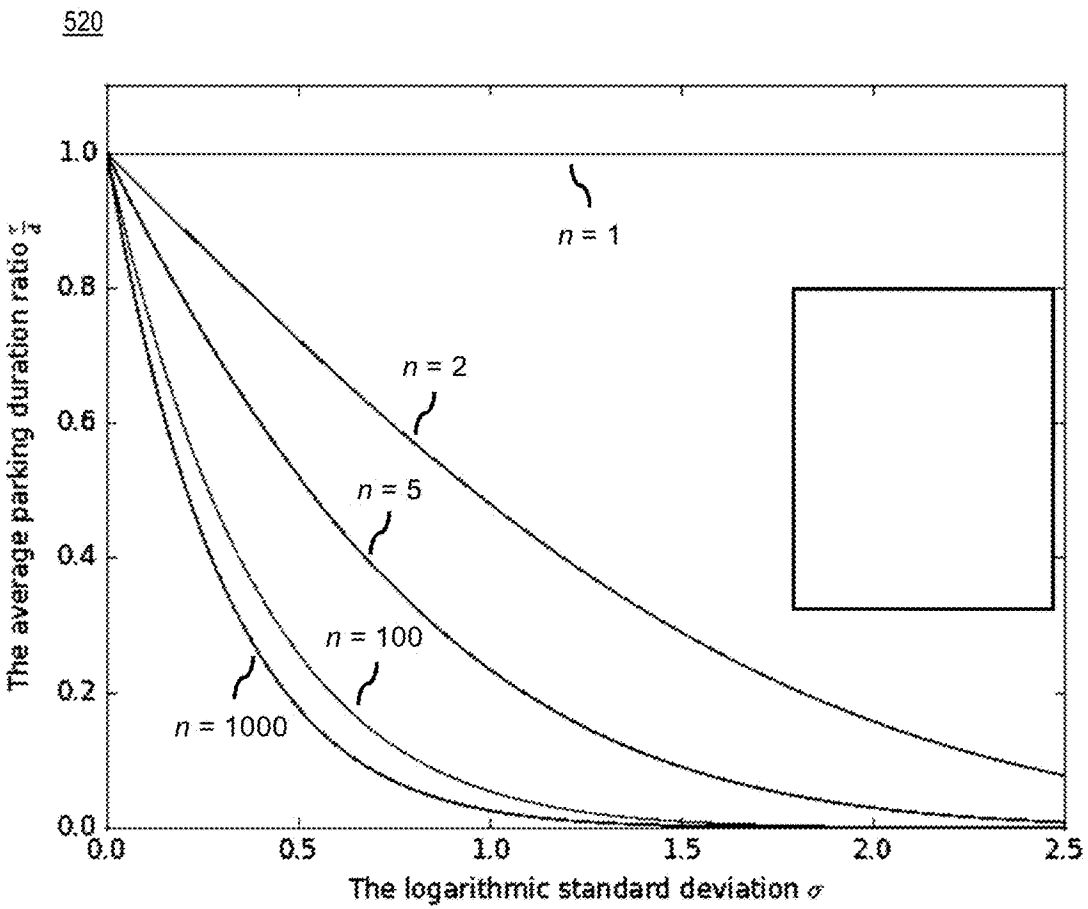
FIG. 5B is an example of a log-normal parking duration distribution, according to one embodiment.

The mapping from the logarithmic standard deviation a to the average parking duration ratio $\tau/d$ is shown in FIG. 5B.

In step 507, the user interface module 407 presents a user interface of a device (e.g., a navigation system of the vehicle 201, navigation application 225 of the UE 215, etc.) to display the estimated waiting time to park. In one embodiment, the user interface is presented at the device when the device is detected to approach the parking area within a distance threshold. In one embodiment, the user interface is presented at the device when the device requests a navigation route to a destination within a threshold distance of the parking area. Additional details of the presentation of the waiting time to park is described below with respect to FIGS. 6 and 7A-7C.

Figure 6:
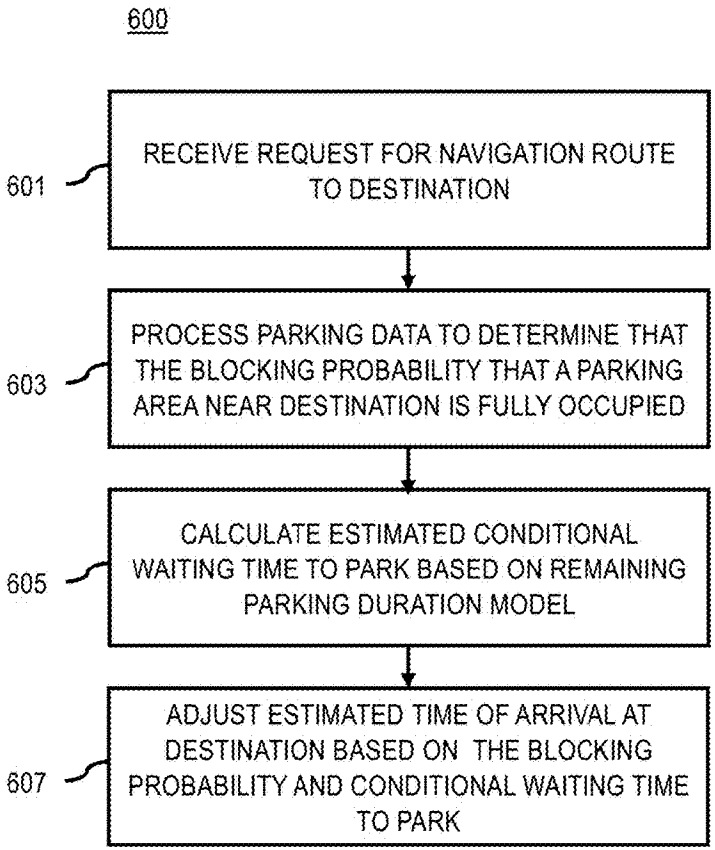
FIG. 6 is a flowchart of a process for adjusting a time of arrival at a destination based on a blocking probability and an estimated conditional waiting time to park, according to one embodiment.

FIG. 6 is a flowchart of a process for adjusting a time of arrival at a destination based on an estimated conditional waiting time to park (e.g., conditioned on a parking area being fully occupied), according to one embodiment. In various embodiments, the parking platform 211 and/or any of the modules 401-407 of the parking platform 211 as shown in FIG. 4 may perform one or more portions of the process 600 and may be implemented in, for instance, a chip set including a processor and a memory as shown in FIG. 9. As such, the parking platform 211 and/or any of the modules 401-407 can provide means for accomplishing various parts of the process 600, as well as means for accomplishing embodiments of other processes described herein in conjunction with other components of the system 200. Although the process 600 is illustrated and described as a sequence of steps, its contemplated that various embodiments of the process 600 may be performed in any order or combination and need not include all of the illustrated steps.

In step 601, the routing module 405 receive, at a navigation device (e.g., a navigation system of the vehicle 201, navigation application 225 of the UE 215, etc.), a request for a navigation route to a destination. In one embodiment, the navigation device is configured to calculate parking information such as parking availability at nearby parking areas and waiting times to park in those areas according to the various embodiments described. In one embodiment, the navigation device includes the parking platform 211 as a local component (e.g., for local or offline calculations) and/or has access to the parking platform 211 over the communication network 213 (e.g., for online calculations) to provided estimated waiting times to park.

Accordingly, in response to the request, in step 603, the parking data module 401 processes parking data from a parking area within a threshold distance of the destination to predict/estimate the probability that all parking spots in the parking area are occupied (e.g., a blocking probability). For example, the parking data module 401 can request or receive real-time parking data to predict/estimate the probability that all available spots in the nearby parking areas are occupied. Alternatively, the parking area itself can report a value to the parking data module 401 as the probability that a parking area is fully occupied without transmitting the underlying parking data collected by the parking sensors 209 and/or vehicles 201 that are parked at the location.

In one embodiment, the routing module 405 can calculate a traditional estimated time of arrival (ETA) at the destination or at a parking area near the destination. The routing module 405 can then interact with the waiting time module 403 to estimate a waiting time to park at a parking area near the destination. For example, in step 605, the waiting time module 403 calculates an average minimum remaining parking duration for a plurality of cars parked in said all parking spots based on the parking data using the traditionally calculated ETA as the specified time for determine a remaining parking duration. The waiting time module 403 then calculates an estimated conditional and/or unconditional waiting time to park in the parking area based on the average minimum remaining parking duration. In one embodiment, these calculations are performed according to the processes described above in steps 503 and 505 of FIG. 5A above.

In step 607, the routing module 405 adjusts an estimated time of arrival (ETA) at the destination based on the estimated waiting time to park. For example, the routing module 405 can compute a traditional ETA (e.g., an ETA that does not account for waiting time to park) using traditional routing algorithms and processes for estimating ETAs known in the art. The routing module 405 can then update or revise the traditional ETA based on the calculated waiting times to park at the parking areas near the destination. In one embodiment, the adjustment can be a probabilistic adjustment based on the blocking probability (e.g., probability that all parking spaces in a parking are occupied as determined above): adjusted ETA=unadjusted ETA+conditional waiting time to park×the blocking probability In one embodiment, if there are multiple parking areas near the destination, the routing module 405 can compute multiple adjusted ETAs that include the respective waiting time to park at each of the nearby parking areas. The routing module 405 can then use a minimum of the adjusted ETAs to present to the requesting user. In one embodiment, the routing module 405 can consider other factors or preferences of the users (e.g., type of preferred parking areas—such as on-street versus parking garage, cost of parking, distance to parking area, parking time limits, etc.) in selecting from among available parking areas and their adjusted ETAs.

Figure 7A:
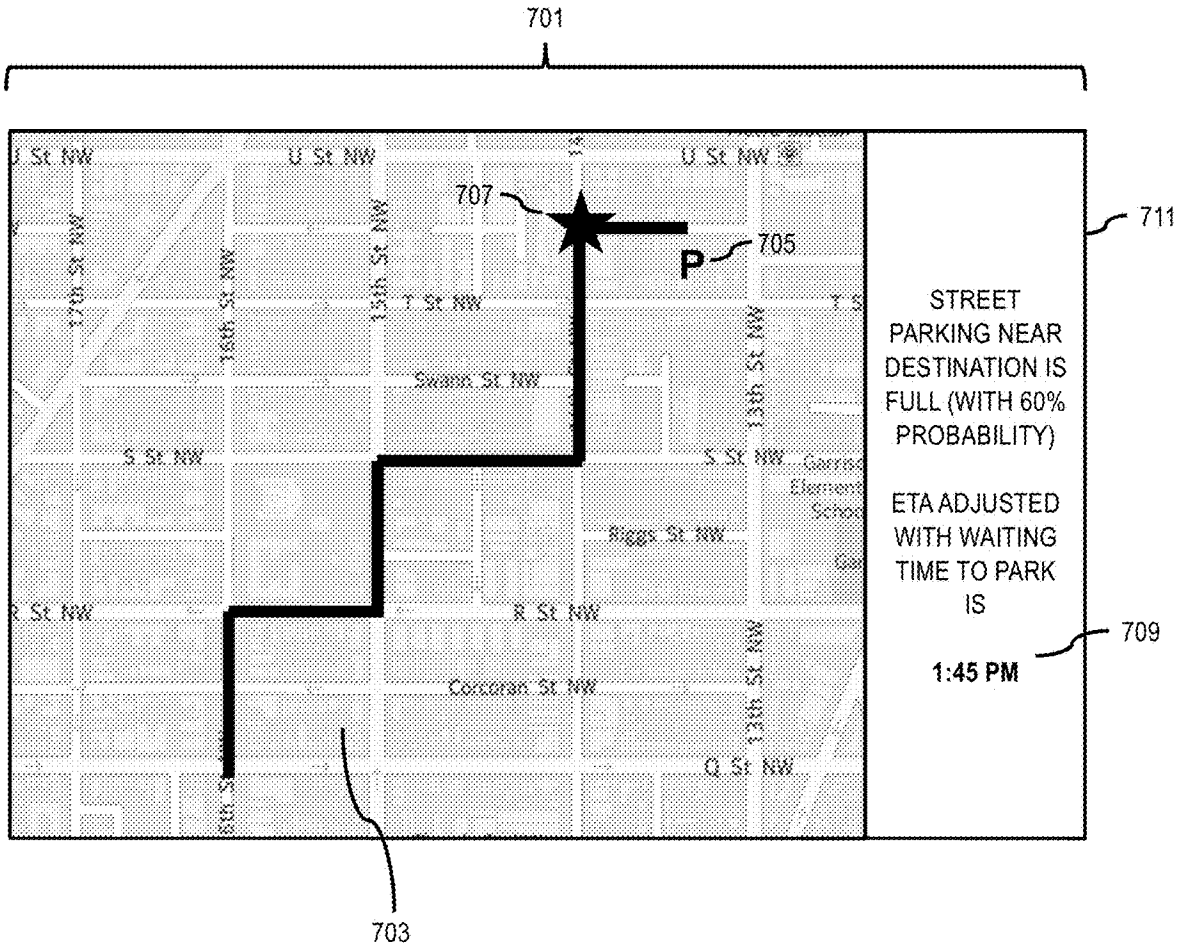
FIGS. 7A-7C are diagrams of example user interfaces for presenting an estimated conditional and/or unconditional waiting time to park, according to various embodiments.

In one embodiment, the user interface module 407 can present the adjusted ETA using any type of presentation or user interface available on the navigation device as a single value in a user interface of the navigation device. The single value, for instance, is the adjusted estimated time of arrival. For example, as shown in FIG. 7A, the user interface module 407 can present a navigation user interface (UI) 701 showing a navigation route 703 to a parking area 705 near a final destination 707. In this example, the parking platform 211 initiates calculation of a waiting time to park for the parking area 705 based on remaining parking duration information according to the various embodiments described herein. The calculated waiting time to park is used to adjust the traditionally calculated ETA to adjust ETA. This adjusted ETA 709 (e.g., 1:45 PM) is then presented in the notification area 711 of the UI 701 along with a message indicating that street parking is fully occupied near the destination 707 at a determined probability (e.g., 60%). In one embodiment, the user interface module 407 can shade or color a particular street segment based on its respective blocking probability (e.g., green if the probability is below a threshold, red if the probability is above a threshold, orange or other colors for intermediate threshold ranges, etc.).

Figure 7B:
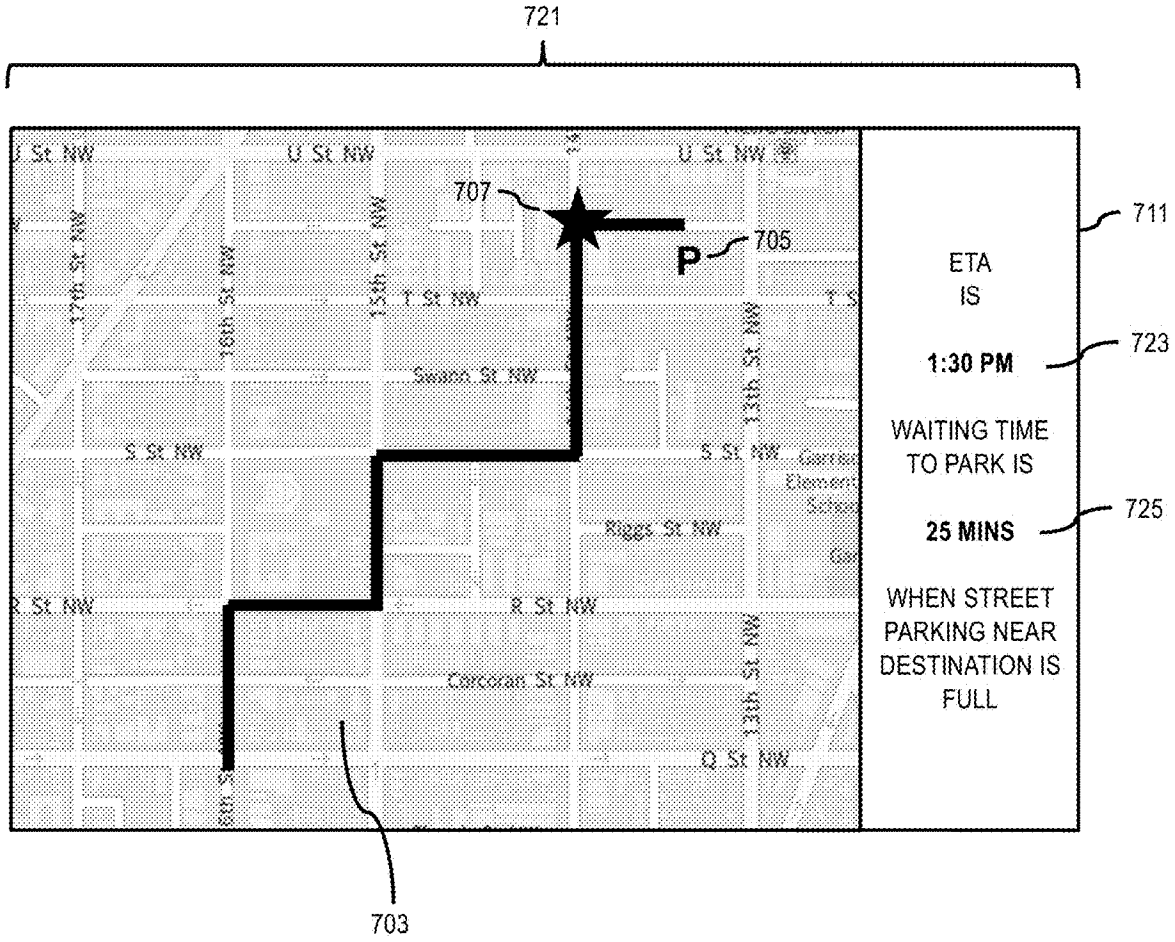

In addition or alternatively, the user interface module 407 can present or provide information to present the estimated time of arrival as a first value and a second value in a user interface of the navigation device. The first value is the estimated time of arrival before the adjusting, and the second value is the estimated conditional waiting time to park. This embodiment is illustrated in FIG. 7B which depicts a UI 721 with same navigation route 703 to the parking area 705 near the final destination 707. However, in this example, instead of displaying as single adjusted ETA as in FIG. 7A, the parking platform 211 presents the traditionally calculated ETA 723 (e.g., 1:30 PM) and then separately displays the estimated conditional or unconditional waiting time to park 725 (e.g., 25 mins for a conditional waiting time to park, or 25 mins multiplied by the blocking probability of 0.60 for the unconditional waiting time to park) for the parking area 705.

Figure 7C:
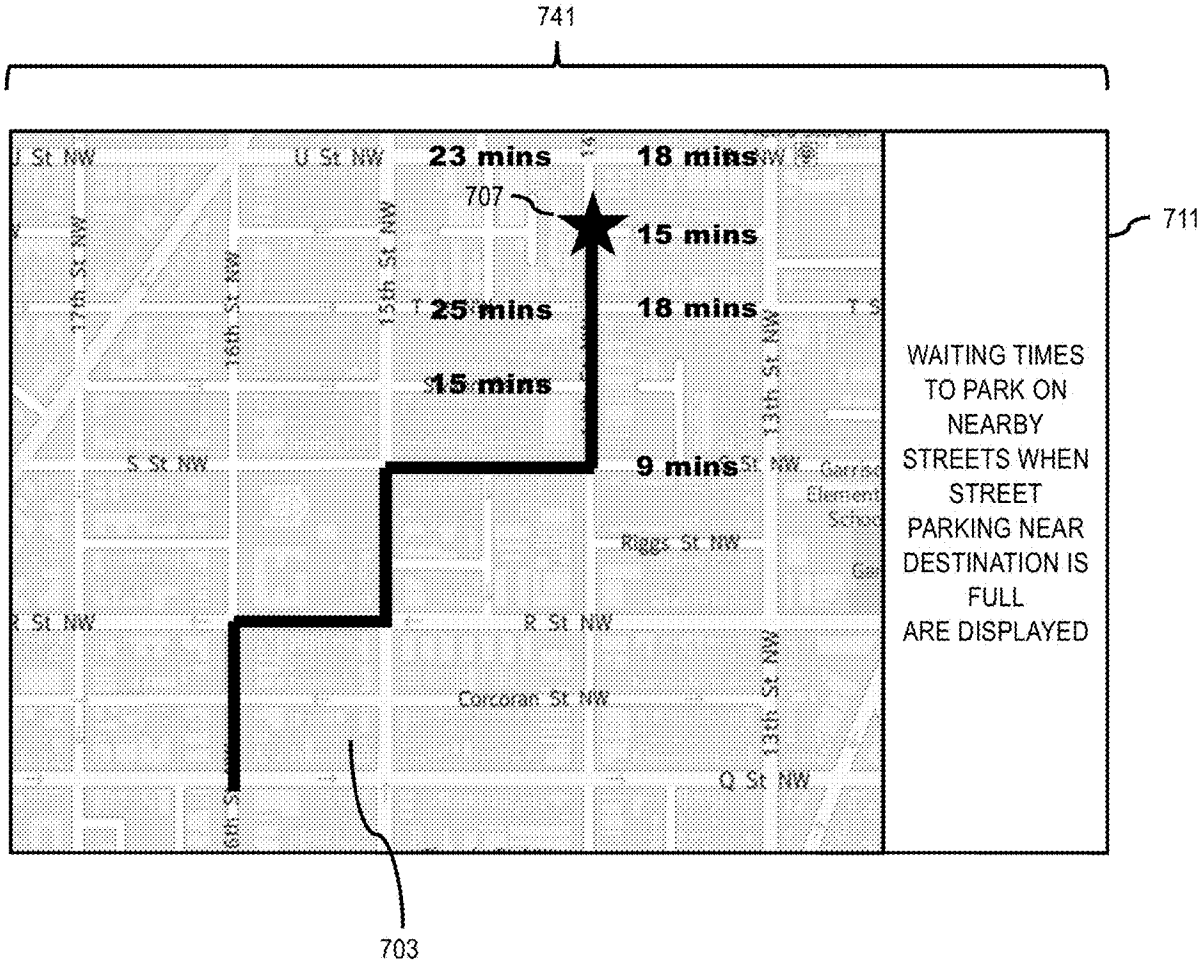

In yet another embodiment, the user interface module 407 can calculate waiting times to park for parking areas near a destination. As shown in FIG. 7C, the user interface module 407 can present a UI 741 which again depicts the same navigation route 703 to the parking area 705 near the final destination 707 as in the example of FIG. 7A. In this example, the parking platform 211 identifies potential parking areas that are within a threshold distance of the destination 707. The parking platform 211 then calculates the estimated waiting times to park for each of the identified parking areas, and presents them in the UI 741. The user interface module 407, for instance, displays the waiting times to park next to each respective parking area (e.g., on-street parking) near the destination 707. The driver can then quickly determine available parking areas and their respective waiting times to park 743 in the UI 741.

In one embodiment, the waiting times to park can be continuously updated based on the expected time that the requesting vehicle 201 is expected to arrive at a particular parking area location. This expected arrival time can be used as the specified time from which the average minimum remaining parking duration and ultimately the waiting times to park can be calculated. In one embodiment, as the requesting vehicle 201 moves within the mapped area, the nearby parking areas can be updated so that waiting times to park 743 for those parking areas can be estimated and presented in the UI 741.

The processes described herein for providing an estimation of waiting time to park may be advantageously implemented via software, hardware (e.g., general processor, Digital Signal Processing (DSP) chip, an Application Specific Integrated Circuit (ASIC), Field Programmable Gate Arrays (FPGAs), etc.), firmware or a combination thereof. Such exemplary hardware for performing the described functions is detailed below.

Figure 8:
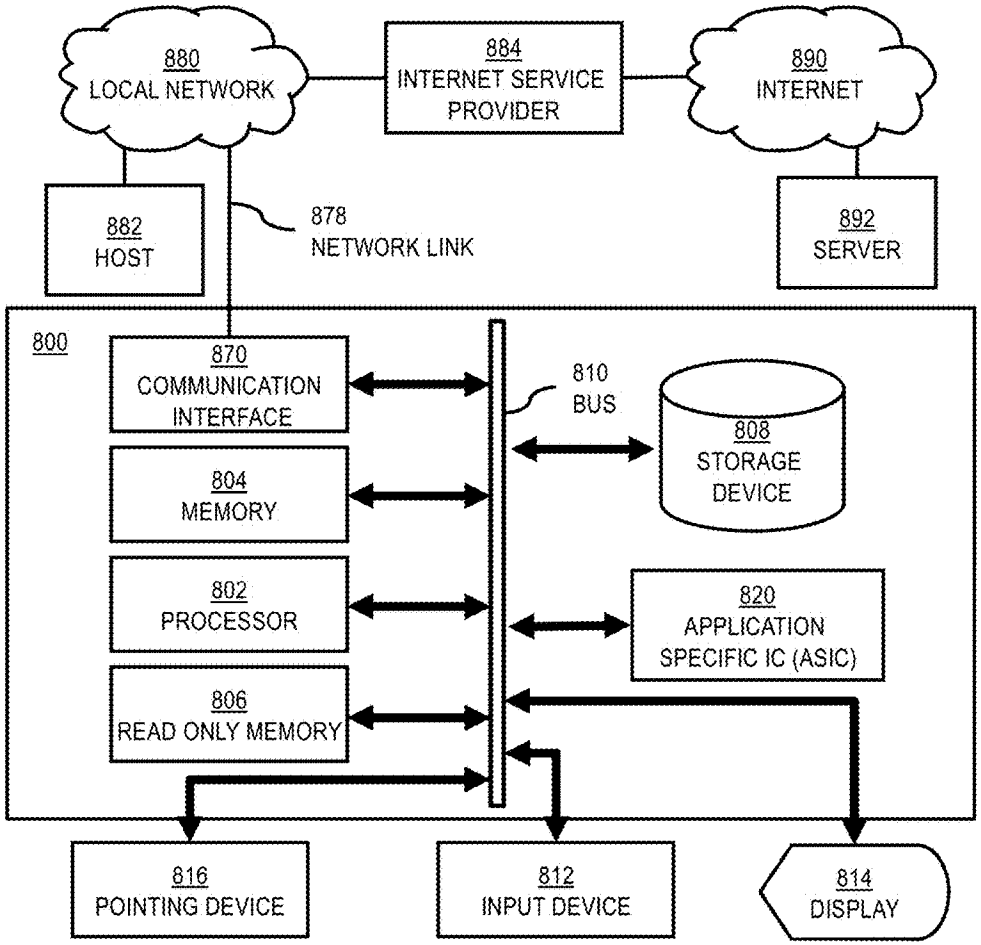
FIG. 8 is a diagram of hardware that can be used to implement an embodiment.

FIG. 8 illustrates a computer system 800 upon which an embodiment of the invention may be implemented. Computer system 800 is programmed (e.g., via computer program code or instructions) to provide an estimation of waiting time as described herein and includes a communication mechanism such as a bus 810 for passing information between other internal and external components of the computer system 800. Information (also called data) is represented as a physical expression of a measurable phenomenon, typically electric voltages, but including, in other embodiments, such phenomena as magnetic, electromagnetic, pressure, chemical, biological, molecular, atomic, sub-atomic and quantum interactions. For example, north and south magnetic fields, or a zero and non-zero electric voltage, represent two states (0, 1) of a binary digit (bit). Other phenomena can represent digits of a higher base. A superposition of multiple simultaneous quantum states before measurement represents a quantum bit (qubit). A sequence of one or more digits constitutes digital data that is used to represent a number or code for a character. In some embodiments, information called analog data is represented by a near continuum of measurable values within a particular range.

A bus 810 includes one or more parallel conductors of information so that information is transferred quickly among devices coupled to the bus 810. One or more processors 802 for processing information are coupled with the bus 810.

A processor 802 performs a set of operations on information as specified by computer program code related to providing an estimation of waiting time to park. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 810 and placing information on the bus 810. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 802, such as a sequence of operation codes, constitute processor instructions, also called computer system instructions or, simply, computer instructions. Processors may be implemented as mechanical, electrical, magnetic, optical, chemical or quantum components, among others, alone or in combination.

Computer system 800 also includes a memory 804 coupled to bus 810. The memory 804, such as a random access memory (RAM) or other dynamic storage device, stores information including processor instructions for providing an estimation of waiting time to park. Dynamic memory allows information stored therein to be changed by the computer system 800. RAM allows a unit of information stored at a location called a memory address to be stored and retrieved independently of information at neighboring addresses. The memory 804 is also used by the processor 802 to store temporary values during execution of processor instructions. The computer system 800 also includes a read only memory (ROM) 806 or other static storage device coupled to the bus 810 for storing static information, including instructions, that is not changed by the computer system 800. Some memory is composed of volatile storage that loses the information stored thereon when power is lost.

Also coupled to bus 810 is a non-volatile (persistent) storage device 808, such as a magnetic disk, optical disk or flash card, for storing information, including instructions, that persists even when the computer system 800 is turned off or otherwise loses power.

Information, including instructions for providing an estimation of waiting time to park, is provided to the bus 810 for use by the processor from an external input device 812, such as a keyboard containing alphanumeric keys operated by a human user, or a sensor. A sensor detects conditions in its vicinity and transforms those detections into physical expression compatible with the measurable phenomenon used to represent information in computer system 800. Other external devices coupled to bus 810, used primarily for interacting with humans, include a display device 814, such as a cathode ray tube (CRT) or a liquid crystal display (LCD), or plasma screen or printer for presenting text or images, and a pointing device 816, such as a mouse or a trackball or cursor direction keys, or motion sensor, for controlling a position of a small cursor image presented on the display 814 and issuing commands associated with graphical elements presented on the display 814. In some embodiments, for example, in embodiments in which the computer system 800 performs all functions automatically without human input, one or more of external input device 812, display device 814 and pointing device 816 is omitted.

In the illustrated embodiment, special purpose hardware, such as an application specific integrated circuit (ASIC) 820, is coupled to bus 810. The special purpose hardware is configured to perform operations not performed by processor 802 quickly enough for special purposes. Examples of application specific ICs include graphics accelerator cards for generating images for display 814, cryptographic boards for encrypting and decrypting messages sent over a network, speech recognition, and interfaces to special external devices, such as robotic arms and medical scanning equipment that repeatedly perform some complex sequence of operations that are more efficiently implemented in hardware.

Computer system 800 also includes one or more instances of a communications interface 870 coupled to bus 810. Communication interface 870 provides a one-way or two-way communication coupling to a variety of external devices that operate with their own processors, such as printers, scanners and external disks. In general the coupling is with a network link 878 that is connected to a local network 880 to which a variety of external devices with their own processors are connected. For example, communication interface 870 may be a parallel port or a serial port or a universal serial bus (USB) port on a personal computer. In some embodiments, communications interface 870 is an integrated services digital network (ISDN) card or a digital subscriber line (DSL) card or a telephone modem that provides an information communication connection to a corresponding type of telephone line. In some embodiments, a communication interface 870 is a cable modem that converts signals on bus 810 into signals for a communication connection over a coaxial cable or into optical signals for a communication connection over a fiber optic cable. As another example, communications interface 870 may be a local area network (LAN) card to provide a data communication connection to a compatible LAN, such as Ethernet. Wireless links may also be implemented. For wireless links, the communications interface 870 sends or receives or both sends and receives electrical, acoustic or electromagnetic signals, including infrared and optical signals, that carry information streams, such as digital data. For example, in wireless handheld devices, such as mobile telephones like cell phones, the communications interface 870 includes a radio band electromagnetic transmitter and receiver called a radio transceiver. In certain embodiments, the communications interface 870 enables connection to the communication network 213 for providing an estimation of waiting time to park.

The term computer-readable medium is used herein to refer to any medium that participates in providing information to processor 802, including instructions for execution. Such a medium may take many forms, including, but not limited to, non-volatile media, volatile media and transmission media. Non-volatile media include, for example, optical or magnetic disks, such as storage device 808. Volatile media include, for example, dynamic memory 804. Transmission media include, for example, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, any other memory chip or cartridge, a carrier wave, or any other medium from which a computer can read.

FIG. 9 illustrates a chip set 900 upon which an embodiment of the invention may be implemented. Chip set 900 is programmed to provide an estimation of waiting time to park as described herein and includes, for instance, the processor and memory components described with respect to FIG. 8 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set can be implemented in a single chip.

In one embodiment, the chip set 900 includes a communication mechanism such as a bus 901 for passing information among the components of the chip set 900. A processor 903 has connectivity to the bus 901 to execute instructions and process information stored in, for example, a memory 905. The processor 903 may include one or more processing cores with each core configured to perform independently. A multi-core processor enables multiprocessing within a single physical package. Examples of a multi-core processor include two, four, eight, or greater numbers of processing cores. Alternatively or in addition, the processor 903 may include one or more microprocessors configured in tandem via the bus 901 to enable independent execution of instructions, pipelining, and multithreading. The processor 903 may also be accompanied with one or more specialized components to perform certain processing functions and tasks such as one or more digital signal processors (DSP) 907, or one or more application-specific integrated circuits (ASIC) 909. A DSP 907 typically is configured to process real-world signals (e.g., sound) in real time independently of the processor 903. Similarly, an ASIC 909 can be configured to performed specialized functions not easily performed by a general purposed processor. Other specialized components to aid in performing the inventive functions described herein include one or more field programmable gate arrays (FPGA) (not shown), one or more controllers (not shown), or one or more other special-purpose computer chips.

The processor 903 and accompanying components have connectivity to the memory 905 via the bus 901. The memory 905 includes both dynamic memory (e.g., RAM, magnetic disk, writable optical disk, etc.) and static memory (e.g., ROM, CD-ROM, etc.) for storing executable instructions that when executed perform the inventive steps described herein to provide an estimation of waiting time to park. The memory 905 also stores the data associated with or generated by the execution of the inventive steps.

Figure 10:
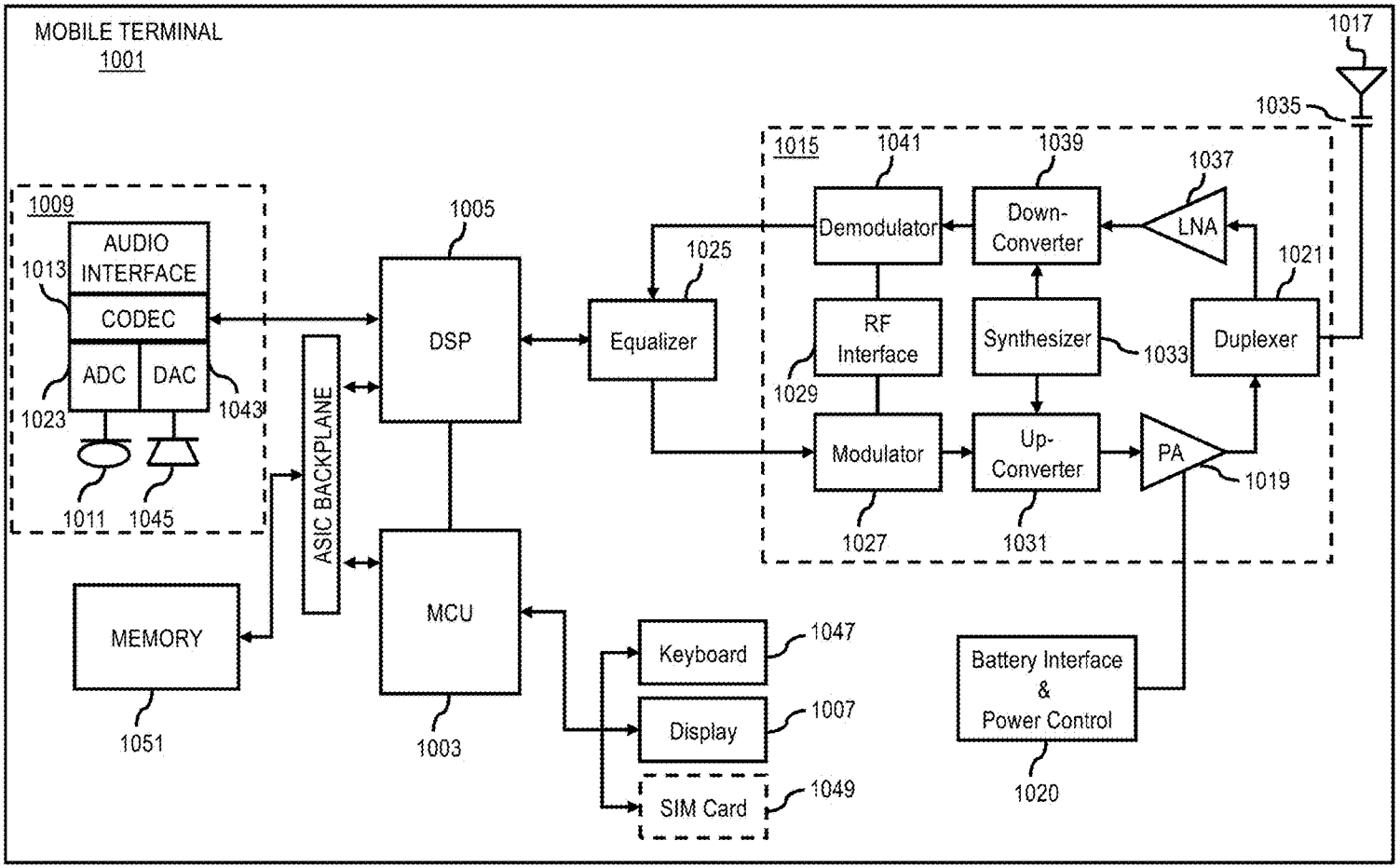
FIG. 10 is a diagram of a mobile terminal (e.g., mobile computer) that can be used to implement an embodiment.

FIG. 10 is a diagram of exemplary components of a mobile station (e.g., handset, vehicle 201, or UE 215) capable of operating in the system of FIG. 1, according to one embodiment. Generally, a radio receiver is often defined in terms of front-end and back-end characteristics. The front-end of the receiver encompasses all of the Radio Frequency (RF) circuitry whereas the back-end encompasses all of the base-band processing circuitry. Pertinent internal components of the telephone include a Main Control Unit (MCU) 1003, a Digital Signal Processor (DSP) 1005, and a receiver/transmitter unit including a microphone gain control unit and a speaker gain control unit. A main display unit 1007 provides a display to the user in support of various applications and mobile station functions that offer automatic contact matching. An audio function circuitry 1009 includes a microphone 1011 and microphone amplifier that amplifies the speech signal output from the microphone 1011. The amplified speech signal output from the microphone 1011 is fed to a coder/decoder (CODEC) 1013.

A radio section 1015 amplifies power and converts frequency in order to communicate with a base station, which is included in a mobile communication system, via antenna 1017. The power amplifier (PA) 1019 and the transmitter/modulation circuitry are operationally responsive to the MCU 1003, with an output from the PA 1019 coupled to the duplexer 1021 or circulator or antenna switch, as known in the art. The PA 1019 also couples to a battery interface and power control unit 1020.

In use, a user of mobile station 1001 speaks into the microphone 1011 and his or her voice along with any detected background noise is converted into an analog voltage. The analog voltage is then converted into a digital signal through the Analog to Digital Converter (ADC) 1023. The control unit 1003 routes the digital signal into the DSP 1005 for processing therein, such as speech encoding, channel encoding, encrypting, and interleaving. In one embodiment, the processed voice signals are encoded, by units not separately shown, using a cellular transmission protocol such as global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., microwave access (WiMAX), Long Term Evolution (LTE) networks, code division multiple access (CDMA), wireless fidelity (WiFi), satellite, and the like.

The encoded signals are then routed to an equalizer 1025 for compensation of any frequency-dependent impairments that occur during transmission though the air such as phase and amplitude distortion. After equalizing the bit stream, the modulator 1027 combines the signal with a RF signal generated in the RF interface 1029. The modulator 1027 generates a sine wave by way of frequency or phase modulation. In order to prepare the signal for transmission, an up-converter 1031 combines the sine wave output from the modulator 1027 with another sine wave generated by a synthesizer 1033 to achieve the desired frequency of transmission. The signal is then sent through a PA 1019 to increase the signal to an appropriate power level. In practical systems, the PA 1019 acts as a variable gain amplifier whose gain is controlled by the DSP 1005 from information received from a network base station. The signal is then filtered within the duplexer 1021 and optionally sent to an antenna coupler 1035 to match impedances to provide maximum power transfer. Finally, the signal is transmitted via antenna 1017 to a local base station. An automatic gain control (AGC) can be supplied to control the gain of the final stages of the receiver. The signals may be forwarded from there to a remote telephone which may be another cellular telephone, other mobile phone or a land-line connected to a Public Switched Telephone Network (PSTN), or other telephony networks.

Voice signals transmitted to the mobile station 1001 are received via antenna 1017 and immediately amplified by a low noise amplifier (LNA) 1037. A down-converter 1039 lowers the carrier frequency while the demodulator 1041 strips away the RF leaving only a digital bit stream. The signal then goes through the equalizer 1025 and is processed by the DSP 1005. A Digital to Analog Converter (DAC) 1043 converts the signal and the resulting output is transmitted to the user through the speaker 1045, all under control of a Main Control Unit (MCU) 1003—which can be implemented as a Central Processing Unit (CPU) (not shown).

The MCU 1003 receives various signals including input signals from the keyboard 1047. The keyboard 1047 and/or the MCU 1003 in combination with other user input components (e.g., the microphone 1011) comprise a user interface circuitry for managing user input. The MCU 1003 runs a user interface software to facilitate user control of at least some functions of the mobile station 1001 to provide an estimation of waiting time to park. The MCU 1003 also delivers a display command and a switch command to the display 1007 and to the speech output switching controller, respectively. Further, the MCU 1003 exchanges information with the DSP 1005 and can access an optionally incorporated SIM card 1049 and a memory 1051. In addition, the MCU 1003 executes various control functions required of the station. The DSP 1005 may, depending upon the implementation, perform any of a variety of conventional digital processing functions on the voice signals. Additionally, DSP 1005 determines the background noise level of the local environment from the signals detected by microphone 1011 and sets the gain of microphone 1011 to a level selected to compensate for the natural tendency of the user of the mobile station 1001.

The CODEC 1013 includes the ADC 1023 and DAC 1043. The memory 1051 stores various data including call incoming tone data and is capable of storing other data including music data received via, e.g., the global Internet. The software module could reside in RAM memory, flash memory, registers, or any other form of writable computer-readable storage medium known in the art including non-transitory computer-readable storage medium. For example, the memory device 1051 may be, but not limited to, a single memory, CD, DVD, ROM, RAM, EEPROM, optical storage, or any other non-volatile or non-transitory storage medium capable of storing digital data.

An optionally incorporated SIM card 1049 carries, for instance, important information, such as the cellular phone number, the carrier supplying service, subscription details, and security information. The SIM card 1049 serves primarily to identify the mobile station 1001 on a radio network. The card 1049 also contains a memory for storing a personal telephone number registry, text messages, and user specific mobile station settings.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. A method comprising:

processing parking data from a parking area to determine a blocking probability that all parking spots in the parking area are occupied;

building a remaining parking duration model for a plurality of cars parked in said all parking spots based on the parking data and at least one of a predetermined probability distribution of parking durations and a predetermined probability distribution of remaining parking duration; and calculating a conditional waiting time to park in the parking area based on the remaining parking duration model, wherein a user interface of a device is presented to display the conditional waiting time to park.

2. A method comprising:

processing parking data from a parking area to determine a blocking probability that all parking spots in the parking area are occupied;

building a remaining parking duration model for a plurality of cars parked in said all parking spots based on the parking data;

calculating a conditional waiting time to park in the parking area based on the remaining parking duration model; and calculating an unconditional waiting time to park in the parking area based on the blocking probability and the conditional waiting time to park, wherein a user interface of a device is presented to display the unconditional waiting time to park.

3. The method of claim 1, further comprising:

classifying all path segments between a driver parking search starting point to a driver parking search end point as occupied to determine the blocking probability, wherein the user interface is presented at the device when the device is detected to approach the parking area within a distance threshold.

4. The method of claim 1, wherein the user interface is presented at the device when the device requests a navigation route to a destination within a threshold distance of the parking area.

5. The method of claim 1, further comprising:

calculating a remaining parking duration at a specified time for each of the plurality of cars from the parking data using the at least one of the predetermined probability distributions, to build the remaining parking duration model, wherein the remaining parking duration is a duration from the specified time to when said each of the plurality of cars leaves one of said all parking spots, and wherein the remaining parking duration model is based on the remaining parking duration for said each of the plurality of cars.

6. The method of claim 5, further comprising:

calculating a cumulative distribution function of the remaining parking duration for said each of the plurality of cars; and calculating a probability density function of the remaining parking duration for said each of the plurality of cars from the cumulative distribution function, wherein the remaining parking duration model is based on the probability density function.

7. The method of claim 1, wherein the at least one of the predetermined probability distributions include an exponential distribution, a log-normal distribution, or a combination thereof.

8. The method of claim 1, wherein the parking data is collected from one or more parking sensors.

9. The method of claim 8, wherein the one or more parking sensors include one or more embedded sensors in the parking area, one or more vehicle sensors of a plurality of cars parked in said all parking spots, or a combination thereof.

10. The method of claim 1, wherein the parking data is collected in real-time from a plurality of vehicles parking in the parking area, and wherein the estimated waiting time to park is a real-time estimation.

11. An apparatus comprising:

at least one processor; and at least one memory including computer program code for one or more programs, the at least one memory and the computer program code configured to, with the at least one processor, cause the apparatus to perform at least the following, receive, at a navigation device, a request for a navigation route to a destination;

process parking data from a parking area within a threshold distance of the destination to determine a probability to park in the parking area;

build a remaining parking duration model for a plurality of cars parked in said all parking spots based on the parking data and at least one of a predetermined probability distribution of parking durations and a predetermined probability distribution of remaining parking duration;

calculate an estimated conditional waiting time to park in the parking area based on the remaining parking duration model; and adjust an estimated time of arrival at the destination based on the estimated conditional waiting time to park.

12. An apparatus comprising:

at least one processor; and at least one memory including computer program code for one or more programs, the at least one memory and the computer program code configured to, with the at least one processor, cause the apparatus to perform at least the following, receive, at a navigation device, a request for a navigation route to a destination;

process parking data from a parking area within a threshold distance of the destination to determine a probability to park in the parking area;

build a remaining parking duration model for a plurality of vehicles parked in said all parking spots based on the parking data;

calculate an estimated conditional waiting time to park in the parking area based on the remaining parking duration model; and calculate an estimated unconditional waiting time to park in the parking area based on the probability to park and the estimated conditional waiting time to park, wherein an estimated time of arrival at the destination is adjusted based on the estimated unconditional waiting time to park.

13. The apparatus of claim 11, wherein the apparatus is further caused to:

present the estimated time of arrival as a single value in a user interface of the navigation device, wherein the single value is the adjusted estimated time of arrival.

14. The apparatus of claim 11, wherein the apparatus is further caused to:

present the estimated time of arrival as a first value and a second value in a user interface of the navigation device, wherein the first value is the estimated time of arrival before the adjusting; and wherein the second value is the estimated conditional waiting time to park conditioned on that the parking area is fully occupied.

15. The apparatus of claim 11, wherein the apparatus is further caused to:

calculate a remaining parking duration at a specified time for each of the plurality of vehicles from the parking data using the at least one of the predetermined probability distributions, to build the remaining parking duration model, wherein the remaining parking duration is a duration from the specified time to when said each of the plurality of vehicles leaves one of said all parking spots, and wherein the remaining parking duration model is based on the remaining parking duration for said each of the plurality of vehicles.

16. The apparatus of claim 15, wherein the apparatus is further caused to:

calculate a cumulative distribution function of the remaining parking duration for said each of the plurality of vehicles; and calculate a probability density function of the remaining parking duration for said each of the plurality of vehicles from the cumulative distribution function wherein the remaining parking duration model is based on the probability density function.

17. A non-transitory computer-readable storage medium carrying one or more sequences of one or more instructions which, when executed by one or more processors, cause an apparatus to at least perform the following steps:

processing parking data from a parking area to determine a blocking probability that all parking spots in the parking area are occupied;

building a remaining parking duration model for a plurality of cars parked in said all parking spots based on the parking data and at least one of a predetermined probability distribution of parking durations and a predetermined probability distribution of remaining parking duration; and calculating a conditional waiting time to park in the parking area based on the remaining parking duration model.

18. A non-transitory computer-readable storage medium carrying one or more sequences of one or more instructions which, when executed by one or more processors, cause an apparatus to at least perform the following steps:

processing parking data from a parking area to determine a blocking probability that all parking spots in the parking area are occupied;

calculating a remaining parking duration model for a plurality of vehicles parked in said all parking spots based on the parking data;

calculating a conditional waiting time to park in the parking area based on the remaining parking duration model;

calculating an unconditional waiting time to park in the parking area based on the blocking probability and conditional waiting time to park; and presenting a user interface of a device to display the conditional waiting time to park or the unconditional waiting time to park.

19. The non-transitory computer-readable storage medium of claim 17, wherein the apparatus is further caused to perform:

calculating a remaining parking duration at a specified time for each of the plurality of vehicles from the parking data using the at least one of the predetermined probability distributions, to build the remaining parking duration model, wherein the remaining parking duration is a duration from the specified time to when said each of the plurality of vehicles leaves one of said all parking spots, and wherein the remaining parking duration model is based on the remaining parking duration for said each of the plurality of vehicles.

20. The non-transitory computer-readable storage medium of claim 19, wherein the apparatus is further caused to perform:

calculating a cumulative distribution function of the remaining parking duration for said each of the plurality of vehicles; and calculating a probability density function of the remaining parking duration for said each of the plurality of vehicles from the cumulative distribution function wherein the remaining parking duration model is based on the probability density function.

* * * * *